US008387855B2

(12) United States Patent
Brand

(10) Patent No.: US 8,387,855 B2
(45) Date of Patent: Mar. 5, 2013

(54) CARTON WITH INSERT

(75) Inventor: Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 81 days.

(21) Appl. No.: 12/871,058

(22) Filed: Aug. 30, 2010

(65) Prior Publication Data

US 2011/0049228 A1 Mar. 3, 2011

Related U.S. Application Data

(60) Provisional application No. 61/275,403, filed on Aug. 28, 2009.

(51) Int. Cl.
*B65D 5/46* (2006.01)
*B65D 17/00* (2006.01)
*B31B 17/00* (2006.01)

(52) U.S. Cl. ..... 229/117.13; 229/199; 229/244; 493/84

(58) Field of Classification Search ..... 229/117.26, 229/244; 206/141
See application file for complete search history.

(56) References Cited

U.S. PATENT DOCUMENTS

| | | | |
|---|---|---|---|
| 1,925,102 | A | 9/1933 | Levkoff |
| 2,005,924 | A | 6/1935 | Wilsom |
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 3,078,032 | A | 2/1963 | Robinson et al. |
| 3,128,010 | A | 4/1964 | Forrer |
| 3,133,634 | A | 5/1964 | Bozdar |
| 3,173,596 | A | 3/1965 | Aust et al. |

(Continued)

FOREIGN PATENT DOCUMENTS

| | | |
|---|---|---|
| CA | 873185 A1 | 6/1971 |
| EP | 0 066029 | 12/1982 |

(Continued)

OTHER PUBLICATIONS

International Search Report and Written Opinion, mailed May 30, 2011, PCT/US2010/047102.

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A carton for holding a plurality of containers. The carton comprises panels that extend at least partially around an interior of the carton. The panels comprise a top panel, a bottom panel, a first side panel, and a second side panel. At least two end flaps are respectively foldably attached to respective panels and are overlapped with respect to one another to at least partially form a closed end of the carton. A reinforcing insert comprises a central panel at least partially in contact with the top panel, at least one reinforcing end flap at least partially in contact with at least one of the end flaps, and at least one reinforcing side flap foldably connected to the central panel. The carton comprises a dispenser for allowing access to the articles in the carton. The dispenser comprises at least a portion of the top panel and the central panel.

60 Claims, 17 Drawing Sheets

U.S. PATENT DOCUMENTS 3,178,242 A 4/1965 Ellis et al.
3,228,582 A 1/1966 Osberg
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,517,858 A 6/1970 Farquhar
3,533,549 A 10/1970 Gilchrist
3,540,581 A 11/1970 Koolnis
3,825,170 A 7/1974 Aust et al.
3,904,036 A 9/1975 Forrer
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,538,759 A 9/1985 Dutcher
4,577,762 A 3/1986 Kuchenbecker
4,588,084 A 5/1986 Holley, Jr.
4,605,128 A 8/1986 Rieke
4,621,766 A 11/1986 McClure
4,658,984 A 4/1987 Brunner
4,757,938 A 7/1988 Collins
4,817,866 A 4/1989 Wonnacott
4,830,267 A 5/1989 Wilson
4,890,440 A 1/1990 Romagnoli
4,949,845 A 8/1990 Dixon
4,967,901 A 11/1990 Wood
4,974,771 A 12/1990 Lavery
5,072,876 A * 12/1991 Wilson ..... 229/103.2
5,101,642 A 4/1992 Alexandrov
5,119,985 A 6/1992 Dawson et al.
5,137,211 A 8/1992 Summer et al.
5,219,229 A 6/1993 Sengewald
5,249,681 A 10/1993 Miller
5,297,725 A 3/1994 Sutherland
5,320,277 A 6/1994 Stout et al.
5,333,734 A 8/1994 Stout et al.
5,350,109 A 9/1994 Brown et al.
5,425,474 A 6/1995 Dalea et al.
5,482,185 A 1/1996 McNaughton
5,482,203 A 1/1996 Stout
5,505,372 A 4/1996 Edson et al.
5,577,612 A 11/1996 Chesson et al.
5,588,585 A 12/1996 McClure
5,597,114 A 1/1997 Kramedjian et al.
5,622,309 A 4/1997 Matsuda et al.
5,664,683 A 9/1997 Brody
5,690,213 A 11/1997 Matsumura
5,690,230 A 11/1997 Griffith
5,794,778 A 8/1998 Harris
5,826,783 A 10/1998 Stout
5,873,516 A 2/1999 Boggs
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,170,741 B1 1/2001 Skolik et al.
6,176,419 B1 1/2001 Holley, Jr.
6,250,542 B1 6/2001 Negelen
6,283,293 B1 9/2001 Lingamfelter
6,302,320 B1 10/2001 Stout
6,409,077 B1 6/2002 Telesca et al.
D459,927 S 7/2002 Flowers et al.
6,471,120 B1 10/2002 Vogel
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,669,083 B2 12/2003 Bates
6,715,639 B2 4/2004 Spivey
6,752,262 B1 6/2004 Boriani et al.
6,789,673 B2 9/2004 Lingamfelter
6,848,573 B2 2/2005 Gould et al.
6,866,186 B2 3/2005 Fogle et al.
6,902,104 B2 6/2005 Holley, Jr. et al.
6,918,487 B2 7/2005 Harrelson
6,926,193 B2 8/2005 Smalley
6,929,172 B2 8/2005 Bates et al.
6,932,265 B2 8/2005 Sax et al.
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,073,665 B2 7/2006 Auclair et al.
7,104,435 B2 9/2006 Holley, Jr.
7,134,593 B2 11/2006 Harrelson
7,159,759 B2 1/2007 Sutherland et al.
7,225,930 B2 6/2007 Ford et al.
7,422,104 B2 9/2008 Perkinson
7,478,743 B2 1/2009 Holley, Jr.
7,604,157 B2 10/2009 Zammit et al.
7,699,215 B2 4/2010 Spivey, Sr.
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 7/2003 Negelen
2003/0141313 A1 7/2003 Bates
2003/0150759 A1 8/2003 White, Jr.
2003/0192907 A1 10/2003 Bates
2004/0040334 A1 3/2004 Rusnock
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2004/0188508 A1 9/2004 Holley, Jr. et al.
2005/0023170 A1 2/2005 Lingamfelter
2005/0092820 A1 5/2005 Chekroune
2005/0115843 A1 6/2005 Harrelson
2005/0126947 A1 6/2005 Holley, Jr.
2005/0167291 A1 8/2005 Sutherland
2005/0167478 A1 8/2005 Holley, Jr.
2005/0189405 A1 9/2005 Gomes et al.
2005/0263574 A1 12/2005 Schuster
2006/0054522 A1 3/2006 Kline et al.
2006/0081691 A1 4/2006 Smalley
2006/0091193 A1 5/2006 DeBusk
2006/0118606 A1 6/2006 Holley, Jr. et al.
2006/0131370 A1 6/2006 Bates
2006/0175386 A1 8/2006 Holley, Jr.
2006/0231441 A1 10/2006 Gomes
2006/0231600 A1 10/2006 Holley
2006/0249413 A1 11/2006 Auclair et al.
2006/0278689 A1 12/2006 Boshinski et al.
2007/0007325 A1 1/2007 Suzuki et al.
2007/0029371 A1 2/2007 Theelen
2007/0108261 A1 5/2007 Schuster
2007/0131748 A1 6/2007 Brand
2007/0164093 A1 7/2007 Spivey et al.
2007/0181658 A1 8/2007 Sutherland
2007/0205255 A1 9/2007 Dunn
2007/0210144 A1 9/2007 Brand
2007/0251982 A1 11/2007 Brand
2007/0295790 A1 12/2007 Zammit et al.
2008/0023535 A1* 1/2008 Holley, Jr. ..... 229/244

| | | | | |
|---|---|---|---|---|
| 2008/0048014 | A1 * | 2/2008 | Bates | 229/117.13 |
| 2008/0128479 | A1 | 6/2008 | Bates et al. | |
| 2009/0282843 | A1 | 11/2009 | Brand | |
| 2010/0044420 | A1 | 2/2010 | Brand | |
| 2010/0122999 | A1 | 5/2010 | Brand | |
| 2010/0237138 | A1 | 9/2010 | Bradford | |
| 2011/0011924 | A1 | 1/2011 | Spivey et al. | |
| 2011/0049228 | A1 | 3/2011 | Brand | |
| 2011/0290692 | A1 | 12/2011 | Spivey, Sr. | |

FOREIGN PATENT DOCUMENTS

| | | | |
|---|---|---|---|
| EP | 1 433 714 | A2 | 6/2004 |
| EP | 1 698 565 | A2 | 9/2006 |
| FR | 2 549 010 | | 1/1985 |
| GB | 2 264 101 | A | 8/1993 |
| JP | 2002-128064 | A | 5/2002 |
| JP | 2006-111342 | A | 4/2006 |
| JP | 2007-055630 | A | 3/2007 |
| JP | 2007-532421 | A | 11/2007 |
| JP | 2010-149927 | A | 7/2010 |
| KR | 10-0154124 | B1 | 2/1999 |
| KR | 10-0371048 | B1 | 8/2003 |
| WO | WO 96/21603 | | 7/1996 |
| WO | WO 96/29260 | | 9/1996 |
| WO | WO 99/28198 | | 6/1999 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | | 6/2005 |
| WO | WO 2005/100175 | A1 | 10/2005 |
| WO | WO 2006/050210 | A2 | 5/2006 |
| WO | WO 2006/050316 | A1 | 5/2006 |
| WO | WO 2007/076544 | A1 | 7/2007 |

OTHER PUBLICATIONS

International Search Report and Written Opinion dated Oct. 25, 2011 for PCT/US2011/037872.

International Search Report and Written Opinion for PCT/US2012/026050 dated Sep. 21, 2012.

International Search Report and Written Opinion from PCT/US2010/027597 dated Oct. 27, 2010.

International Search Report and Written Opinion from PCT/US2011/051905 dated Apr. 23, 2012.

International Search Report and Written Opinion from PCT/US2011/055233 dated May 17, 2012.

Supplementary European Search Report from EP 10 75 4034 dated May 30, 2012.

International Search Report and Written Opinion for PCT/US2010/041971, dated Mar. 1, 2011.

* cited by examiner

CARTON WITH INSERT

CROSS-REFERENCE TO RELATED APPLICATIONS

This application claims the benefit of U.S. Provisional Patent Application No. 61/275,403, filed Aug. 28, 2009.

INCORPORATION BY REFERENCE

U.S. Provisional Patent Application No. 61/275,403, which was filed on Aug. 28, 2009, is hereby incorporated by reference for all purposes as if presented herein in its entirety.

BACKGROUND OF THE DISCLOSURE

The present disclosure generally relates to cartons for holding and dispensing beverage containers or other types of articles. More specifically, the present disclosure relates to cartons having a reinforcing insert.

SUMMARY OF THE DISCLOSURE

In general, one aspect of the disclosure is directed to a carton for holding a plurality of containers. The carton comprises a plurality of panels that extends at least partially around an interior of the carton. The plurality of panels comprises a top panel, a bottom panel, a first side panel, and a second side panel. At least two end flaps are respectively foldably attached to respective panels of the plurality of panels. The end flaps are overlapped with respect to one another and thereby at least partially form a closed end of the carton. A reinforcing insert comprises a central panel at least partially in face-to-face contact with the top panel, at least one reinforcing end flap at least partially in face-to-face contact with at least one of the at least two end flaps, and at least one reinforcing side flap foldably connected to the central panel. The carton comprises a dispenser for allowing access to the articles in the carton. The dispenser comprises at least a portion of the top panel and at least a portion of the central panel.

In another aspect, the disclosure is generally directed to the combination of a carton blank and a reinforcing insert for forming a carton for holding a plurality of containers. The carton blank comprises a plurality of panels comprising a top panel, a bottom panel, a first side panel, and a second side panel. At least two end flaps are respectively foldably attached to respective panels of the plurality of panels for overlapping to at least partially close an end of a carton formed from the carton blank. The reinforcing insert comprises a central panel at least partially in face-to-face contact with the top panel, at least one reinforcing end flap at least partially in face-to-face contact with at least one of the at least two end flaps, and at least one reinforcing side flap foldably connected to the central panel. Dispenser features comprise at least a portion of the top panel and at least a portion of the central panel.

In another aspect, the disclosure is generally directed to a method of forming a carton. The method comprises obtaining a carton blank comprising a plurality of panels comprising a top panel, a bottom panel, a first side panel, and a second side panel, at least two end flaps respectively foldably attached to respective panels of the plurality of panels. Dispenser features comprises at least a portion of the top panel. The method further comprises obtaining an insert blank comprising a central panel, at least one reinforcing end flap, and at least one reinforcing side flap foldably connected to the central panel.

The dispenser features comprise at least a portion of the central panel. The method further comprises positioning the insert blank relative to the carton blank so that the central panel overlaps at least a portion of the top panel and the reinforcing end flap overlaps at least a portion of at least one flap of the at least two end flaps, and forming an interior of the carton at least partially defined by the plurality of panels. The forming the interior of the carton comprises forming an open-ended sleeve. The method further comprises positioning the at least two end flaps and the at least one reinforcing end flap to at least partially close an end of the open-ended sleeve.

In another aspect, the disclosure is generally directed to carton for holding a plurality of containers. The carton comprises a plurality of panels that extends at least partially around an interior of the carton. The plurality of panels comprises a top panel, a bottom panel, a first side panel, and a second side panel. At least two end flaps are respectively foldably attached to respective panels of the plurality of panels. The end flaps are overlapped with respect to one another to thereby at least partially form a closed end of the carton. The end flaps comprise at least a top end flap and at least one side end flap. The carton further comprises a reinforcing insert comprising a reinforcing end flap at least partially in face-to-face contact with an exterior surface of the at least one side end flap and at least partially in face-to-face contact with an interior surface of the top end flap.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
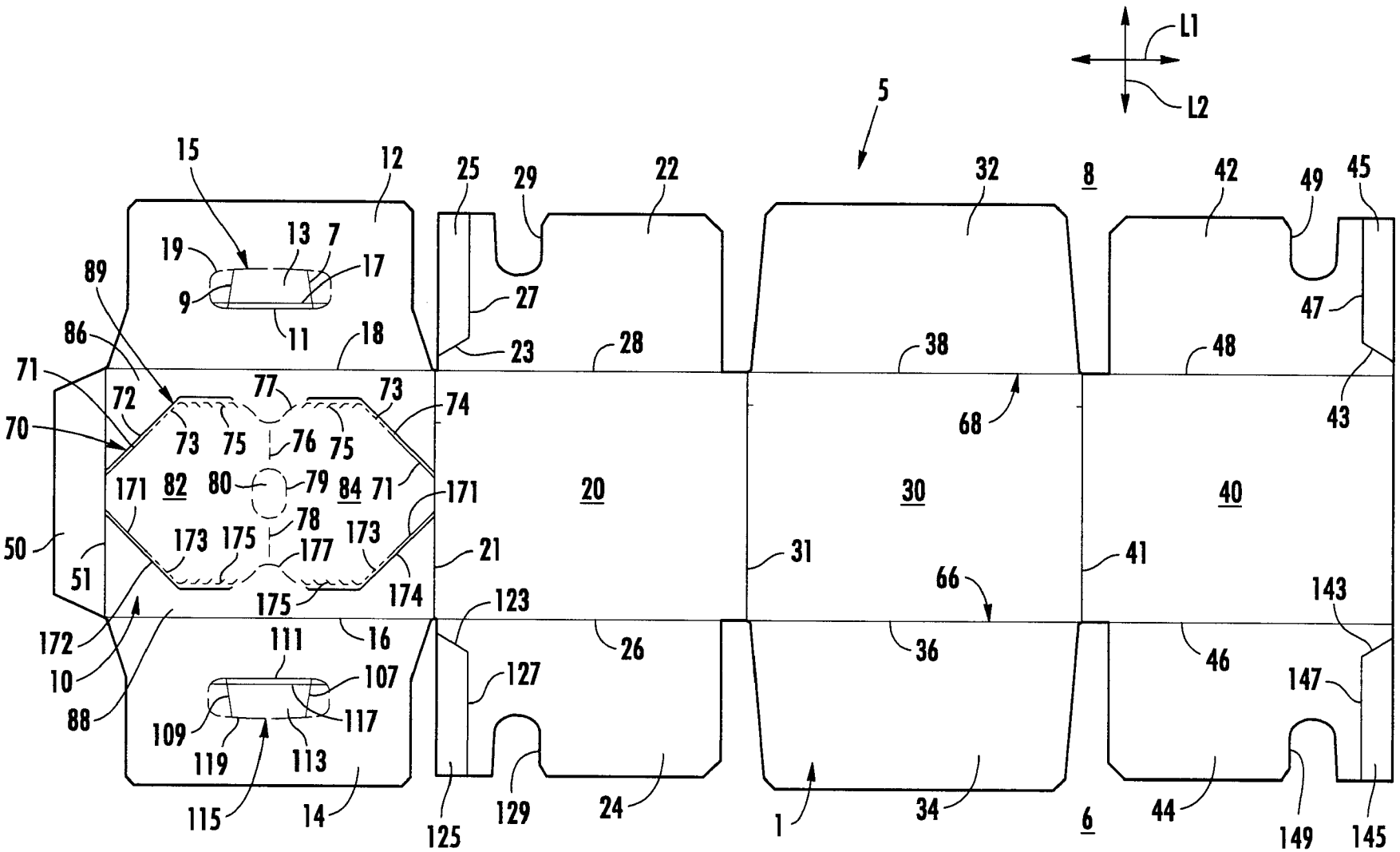
FIG. 1 is an exterior plan view of a carton blank used to form a carton in accordance with one aspect of the disclosure.
Figure 9:
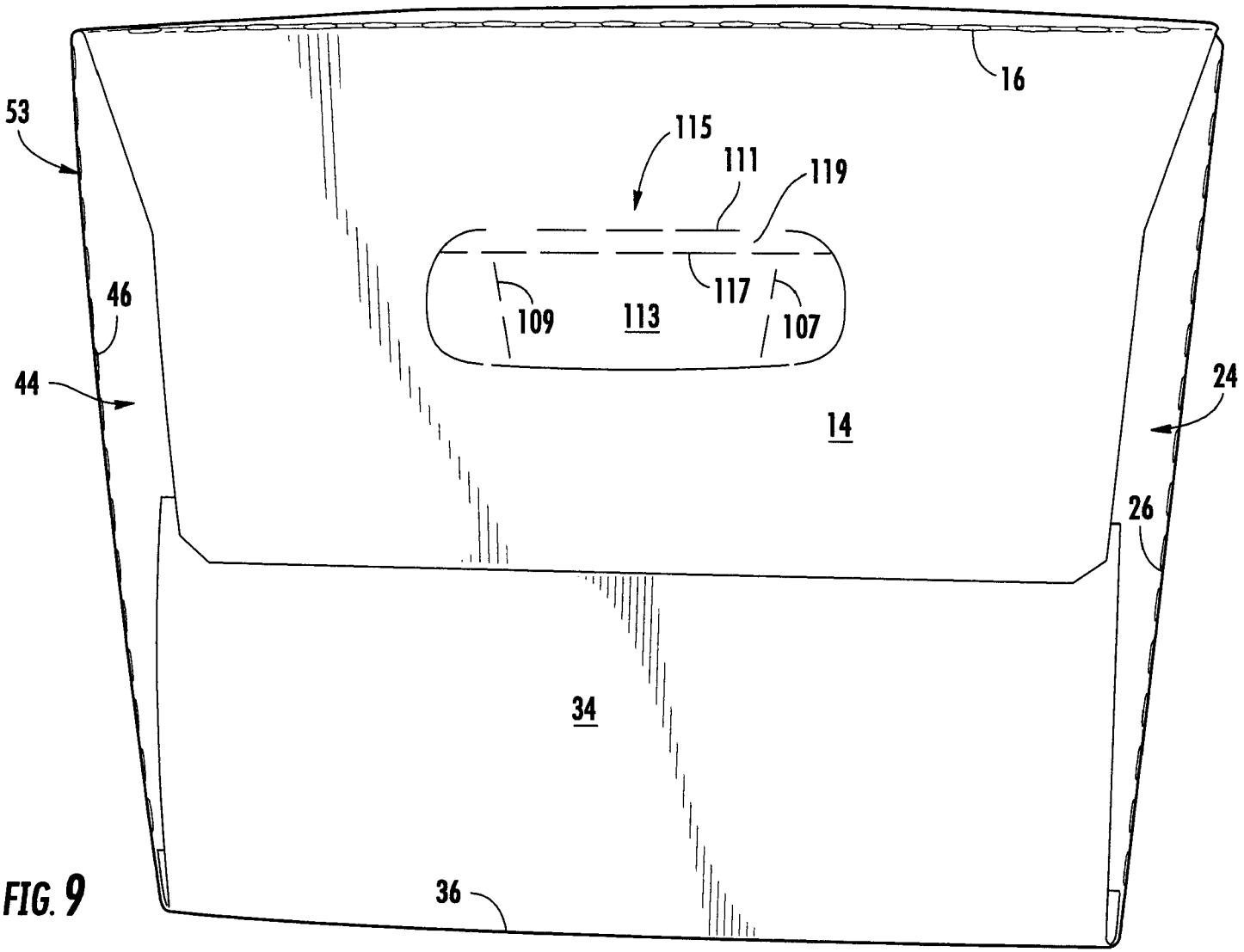
Figure 11:
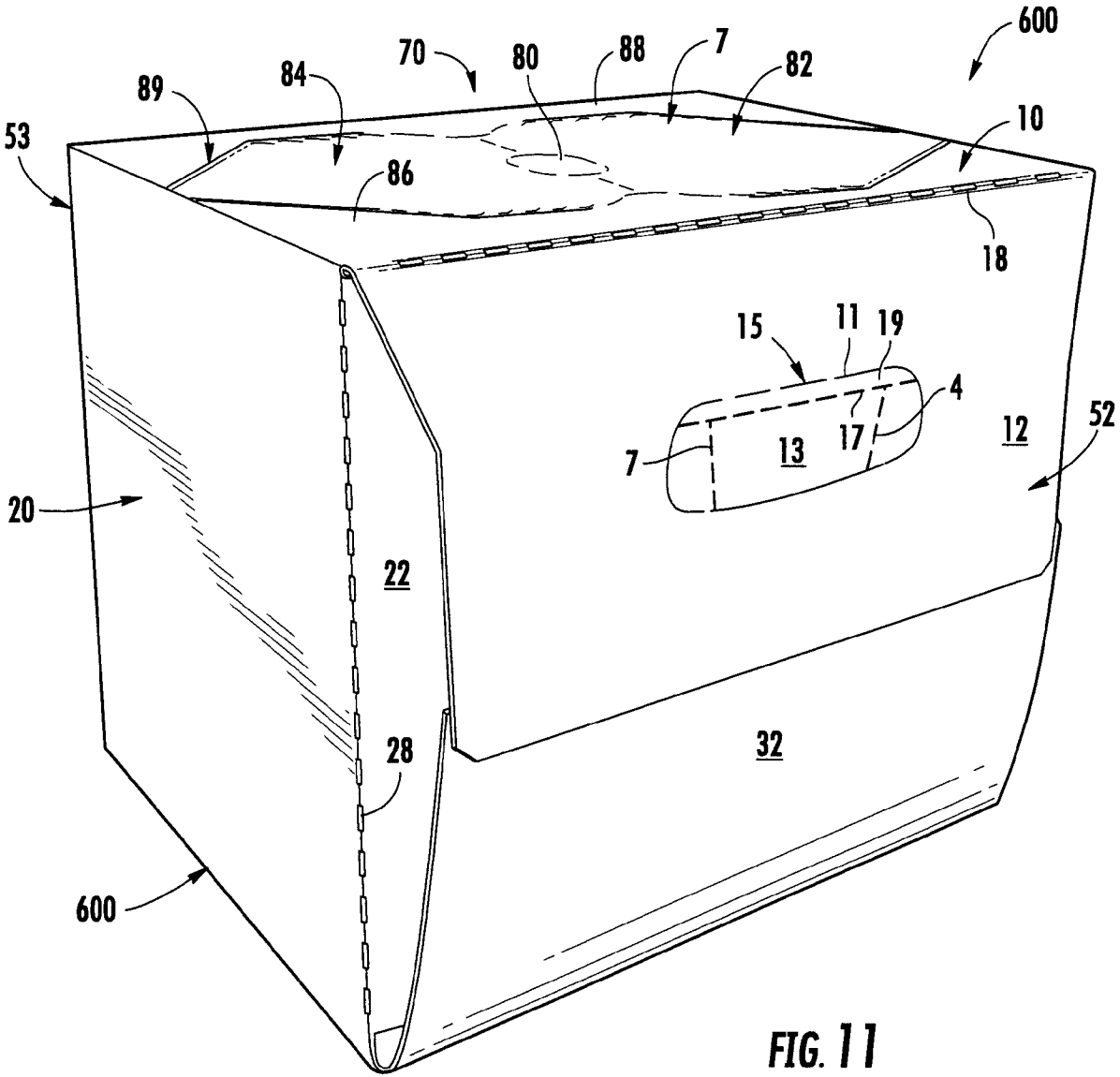
FIG. 11 is a perspective view showing the assembled carton.
Figure 12:
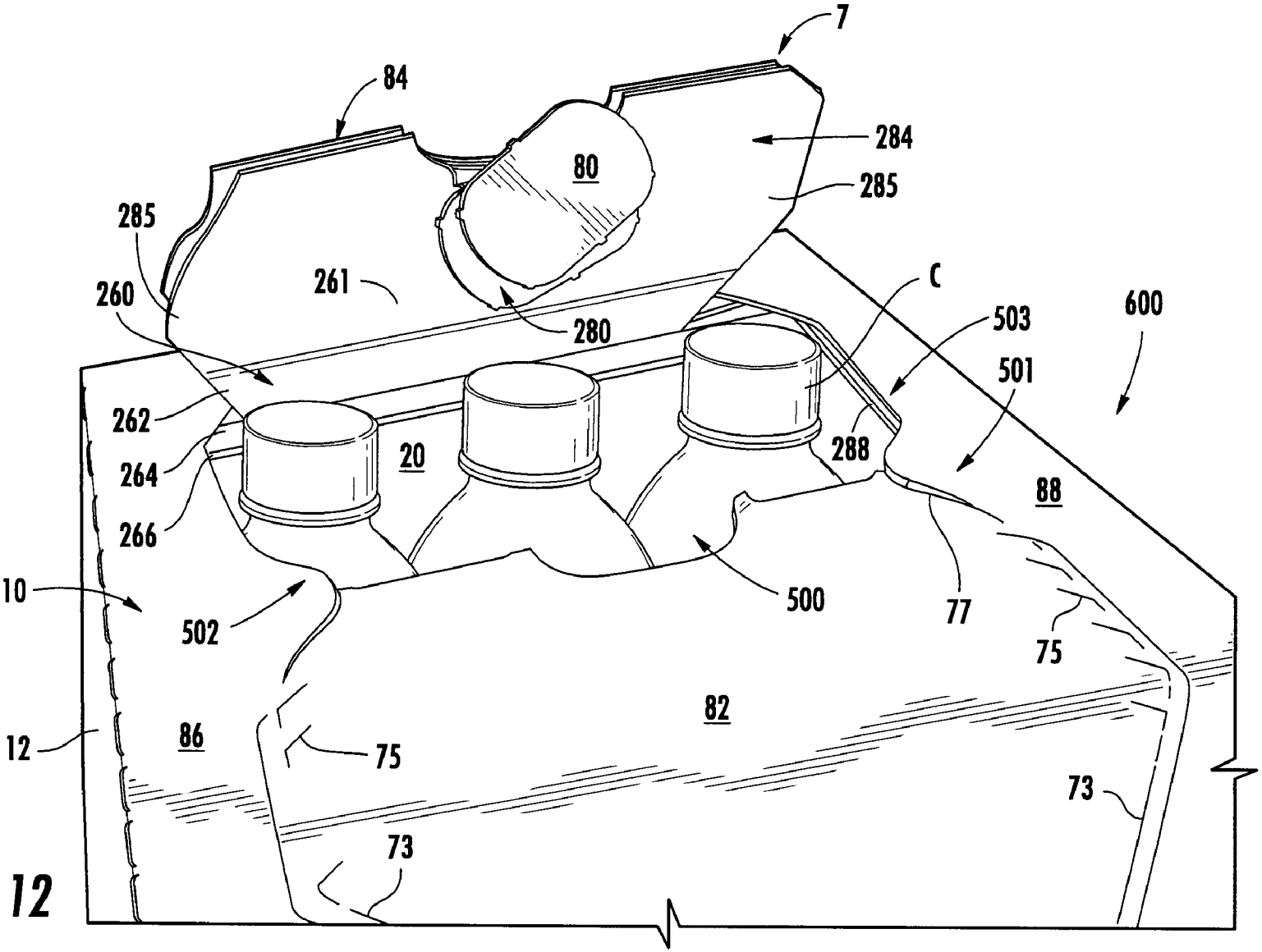
FIG. 12 shows the access flap engaged to hinge open a dispenser panel.

FIG. 1 is a plan view of the exterior side 1 of a blank, generally indicated at 5, used along with the insert blank 200 (FIG. 2) to form a carton 600 (FIG. 11). The carton 600 can be used to house a plurality of articles such as containers C (FIG. 12). The carton 600 has a dispenser, generally indicated at 7 (FIGS. 11 and 12), formed in the carton for allowing access to the containers C. the dispenser 7 can include an outer dispenser 70 in the carton blank 5 and an inner dispenser 270 in the insert blank 200. In the illustrated embodiment, the carton 600 is sized to house twelve containers C in a single layer in a 3×4 arrangement, but it is understood that the carton 600 may be sized and shaped to hold containers of a different or same quantity in more than one layer and/or in different row/column arrangements (e.g., 1×6, 3×6, 2×6×2, 3×4, 3×5, 2×9, 2×6, 3×4, etc.). In the illustrated embodiment, the carton 600 includes a first handle, generally indicated at 15 for grasping and carrying the carton at a first end 52 of the carton (FIG. 11), and a second handle, generally indicated at 115, for grasping and carrying the carton at a second end 53 of the carton (FIG. 9). As will be discussed below in more detail, the handles 15, 115 are formed from various features in the blank 5.

The carton blank 5 has a longitudinal axis L1 and a lateral axis L2. In the illustrated embodiment, the blank 5 comprises a top panel 10 foldably connected to a first side panel 20 at a first lateral fold line 21. A bottom panel 30 is foldably connected to the first side panel 20 at a second lateral fold line 31. A second side panel 40 is foldably connected to the bottom panel 30 at a third lateral fold line 41. In the illustrated embodiment, the blank 5 includes an adhesive flap 50 foldably connected to the top panel 10 at a fourth lateral fold line 51.

The top panel 10 is foldably connected along fold line 18 to a first top end flap 12 and along fold line 16 to a second top end flap 14. The first side panel 20 is foldably connected along fold line 28 to a first side end flap 22 and along fold line 26 to a second side end flap 24. The bottom panel 30 is foldably connected along fold line 38 to a first bottom end flap 32 and along fold line 36 to a second bottom end flap 34. The second side panel 40 is foldably connected along fold line 48 to a first side end flap 42 and along fold line 46 to a second side end flap 44. When the carton 600 is erected, the top and bottom end flaps 12 and 32 and side end flaps 22 and 42 close a first end 52 of the carton (FIG. 11), and the top and bottom end flaps 14 and 34 and side end flaps 24 and 44 close a second end 53 of the carton (FIG. 9). In accordance with alternative embodiments of the present disclosure, different flap arrangements can be used for at least partially closing the ends 52, 53 of the carton 600.

The top and bottom end flaps 12 and 32 and side end flaps 22 and 42 extend along a first marginal area 8 of the blank 5, and are foldably connected along a first longitudinal fold line 68 that extends along the length of the blank and includes fold line segments 18, 28, 38, 48. The top and bottom end flaps 14 and 34 and side end flaps 24 and 44 extend along a second marginal area 6 of the blank 5, and are foldably connected along a second longitudinal fold line 66 that also extends along the length of the blank and includes fold line segments 16, 26, 36, 46. The fold line segments 16, 18, 26, 28, 36, 38, 46, 48, or the longitudinal fold lines 66, 68, may be, for example, substantially straight, or offset at one or more locations to account for blank thickness or for other factors. The end flaps 22, 24, 42, 44 also can include upper flaps 25, 45, 125, 145 defined respectively by cuts 23, 43, 123, 143 and fold lines 27, 47, 127, 147. The upper flaps 24, 45, 125, 145 can fold into the interior of the carton 600 to help secure the containers C therewithin.

As shown in FIG. 1, the outer dispenser 70 is formed in the top panel 10 and includes a first outer dispenser panel 82 and a second outer dispenser panel 84. The first and second dispenser panels 82, 84 are separable from the carton 600 along an outer tear line 89 to form a dispenser opening 500 (FIG. 12) in the carton 600. The first dispenser panel 82 is defined by tear line segments of the outer tear line 89 indicated at 71, 72, 73, 75, 77, 171, 172, 173, 175, and 177, and the second dispenser panel 84 is defined by tear line segments of the outer tear line 89 indicated at 71, 73, 74, 75, 77, 171, 174, 173, 175, and 177. Tear line segments 72, 172 of the first dispenser panel 82 can extend in an oblique direction with respect to longitudinal line L1 from fold line 51 into top panel 10 to turn and extend partially across the top panel 10 in the direction of longitudinal line L1. Tear line segments 74, 174 of the second dispenser panel 84 similarly can extend in a direction oblique with respect to longitudinal line L1 from fold line 21 into top panel 10 to turn and extend partially across the top panel 10 in the direction of longitudinal line L1, with tear line segments 74, 174 extending toward (in an opposite direction to) tear line segments 72, 172. Tear line segments 71, 171 extending generally parallel tear line segments 72, 172, 74, and 174, respectively, for a distance from the fold lines 51, 21, respectively. Tear line segments 73, 173 can extend from end points of tear line segments 71, 171 to the turns of tear line segments, 72, 172, 74, 174. Tear line segments 75 and 175 can extend from the end points of tear line segments 73 and 173 to center tear line segments 77, 177 that curve in an arcuate manner in a direction toward the center of top panel 10. Tear line segments 71, 171, 73, 173, 75, and 175 are spaced from tear line segments 72, 172, 74, and 174, with the spacing between such tear line segments being substantially equal therealong. Alternatively, the tear line 89 with the series of tear line segments shown in FIG. 1 can be replaced with a single tear line, multiple segmented tear lines, or a series of cut lines, or can be otherwise shaped, arranged, and positioned without departing from the scope of this disclosure.

The outer dispenser 70 can include an outer access panel or finger panel 80 in the top panel 10 separable from the carton at an oval-shaped tear line 79, for example. As shown in FIG. 1, the dispenser panels 82, 84 also can be defined by a lateral tear line 76 in the top panel 10 that extends in the lateral direction L2 from one side of the outer finger panel 80 toward arcuate tear line segment 77 and a lateral tear line 78 that extends in the lateral direction L2 from the opposite side of the outer finger panel 80 toward arcuate tear line segment 177. The top panel 10 also includes remainder portions 86 and 88 that extend between the outer dispenser 70 and fold lines 68 and 66, respectively. The tear lines 76, 78, 79, 89 can be otherwise shaped, arranged, and positioned without departing from the scope of this disclosure.

As shown in FIG. 12, the first outer dispenser panel 82 and the second outer dispenser panel 84 of the outer dispenser 70 are opened by tearing along the tear line 89, upwardly folding the first dispenser panel 82 about a portion of the lateral fold line 51 and upwardly folding the second dispenser panel 84 about a portion of the lateral fold line 21. The dispenser 70 may be otherwise sized, shaped, and/or located in the carton 600 without departing from the scope of this disclosure. For example, the tear line 89 can be configured to extend only partially across the top panel 10, wherein one or both of the outer dispenser panels 82, 84 are connected to the top panel 10 at fold lines in the top panel 10 that are not collinear with the fold lines 21, 51. Further, the outer dispenser 70 may be omitted from the carton 600 without departing from the scope of the disclosure.

As shown in FIG. 1, the features that form handle 15 of the carton 600 include an elongate handle flap 13 formed in top end flap 12 and foldably attached to the top end flap at a handle fold line 11 and separable from the top end flap 12 at a tear line 19. Alternatively, tear line 19 can be a series of cut lines. In the illustrated embodiment, the features of handle 15 include two oblique fold lines 7, 9 extending from the fold line 11 and a longitudinal fold line 17 for allowing deformation of the handle flap 13 when activating the handle 15. The features of the handle 15 include respective curved cutouts 29, 49 below the upper portions in the side end flaps 22, 42 that allow the elongate handle flap 13 to fold inwardly when the handle is activated to form a handle opening in the carton. The elongate handle flap 13 can be shaped and positioned in the blank 5 so that the handle 15 is activated by pressing on the handle flap and folding the handle flap inwardly into the curved cutouts 29, 49 to form a handle opening in the carton 600. The opening is shaped for insertion of a user's fingers during grasping of the carton 600. The handle 15 may be otherwise shaped and located in the carton 600 without departing from the scope of this disclosure.

The features that form handle 115 include an elongate handle flap 113 formed in the top end flap 14 and foldably attached to the top end flap at a handle fold line 111 and separable from the top end flap 14 at a tear line 119. Alternatively, tear line 119 can be a series of cut lines. In the illustrated embodiment, the features of handle 115 include two oblique fold lines 107, 109 extending from the fold line 111 and a longitudinal fold line 117 for allowing deformation of the handle flap 113 when activating the handle 115. The features of the handle 115 include respective curved cutouts 129, 149 below the upper portions in the side end flaps 24, 44 that allow the elongate handle flap 113 to fold inwardly when the handle is activated to form a handle opening in the carton. The elongate handle flap 113 can be shaped and positioned in the blank 5 so that the handle 115 is activated by pressing on the handle flap and folding the handle flap inwardly into the curved cutouts 129, 149 to form a handle opening in the carton 600. The opening is shaped for insertion of a user's fingers during grasping of the carton 600. The handle 115 may be otherwise shaped and located in the carton 600 without departing from the scope of this disclosure. Handles 15 and 115 could have different features from one another without departing from the disclosure. Further, either handle 15 or 115 can be omitted without departing from the disclosure.

Figure 2:
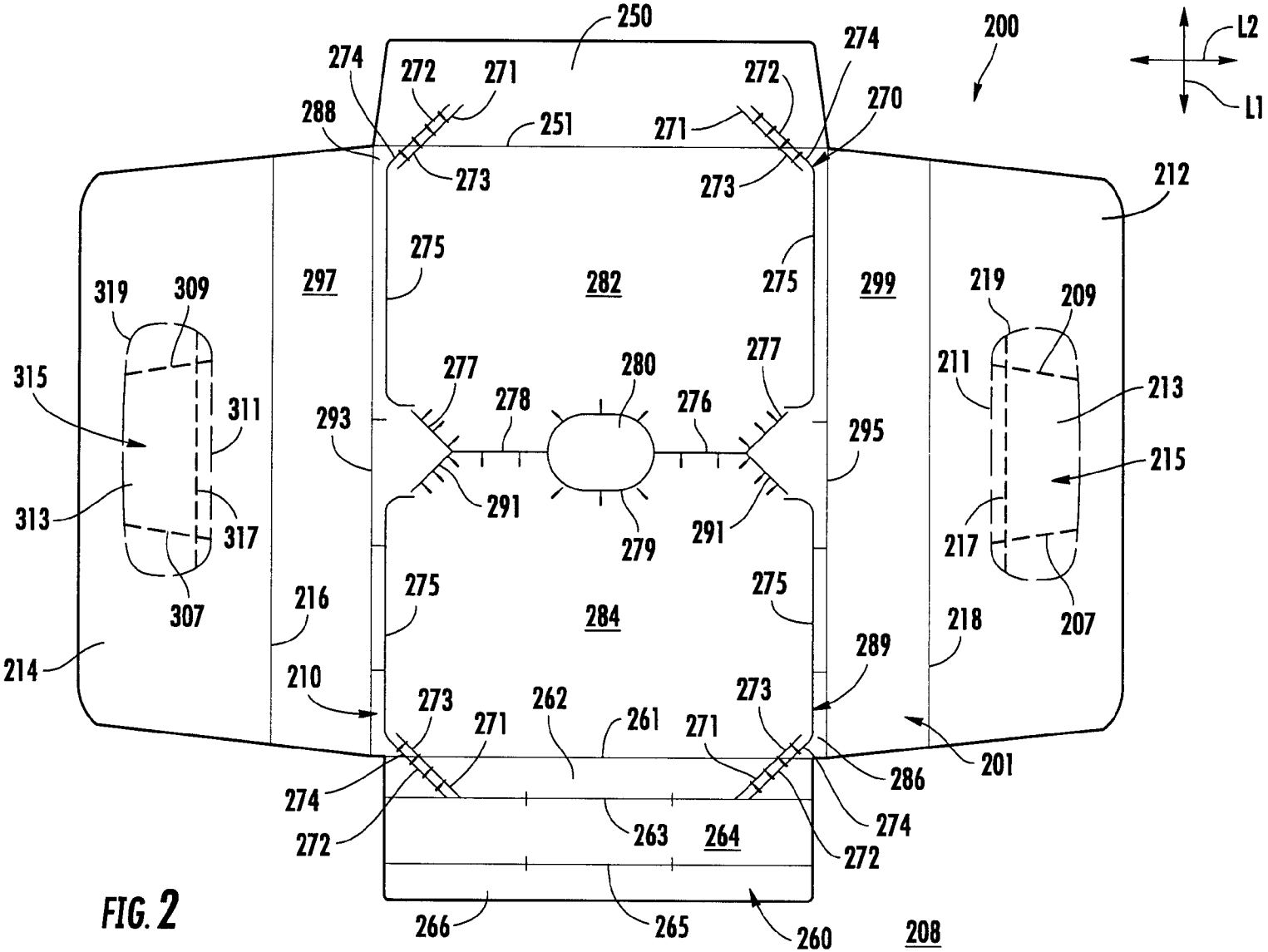
FIG. 2 is an exterior plan view of a first insert blank used to form a reinforcing insert for the carton.

FIG. 2 illustrates a first insert blank 200 used to form a reinforcing insert (FIG. 3) for use in the carton 600. In the illustrated embodiment, the insert blank 200 includes a central panel 210 and two reinforcing end flaps 212, 214 respectively foldably connected to spacer panels 299, 297, which are connected to central panel 210 at opposite ends of the central panel. The insert blank 200 also includes reinforcing side flaps 250 and 260 foldably connected to central panel 210 along fold lines 251, 261, respectively. Spacer panel 299 is connected along a fold line 218 to end flap 212 at a first end of the insert blank 200, and spacer panel 299 is connected along a fold line 295 to center panel 210. Spacer panel 297 is connected along a fold line 216 to end flap 214 at a second end of the insert blank 200, and spacer panel 297 is connected along a fold line 213 to center panel 210. Each end flap 212, 214 is respectively, independently foldable relative to the central panel 210 along respective fold lines 218, 216. These fold lines 218, 216 could be otherwise shaped, arranged, and located (e.g., could comprise areas of weakening) without departing from the scope of this disclosure. Each end flap 212, 214 includes a handle 215, 315 respectively, which generally correspond to handles 15, 115.

As shown in FIG. 2, reinforcing side flap 260 includes panels 262, 264, and 266 foldably connected along fold lines 261, 263, and 265, respectively. Panel 262 is connected along fold line 261 to center panel 210 at one end and is connected along fold line 263 to panel 264 at its other end. Panel 264 is then connected along fold line 265 to panel 266, which extends to a peripheral portion 208 of the insert blank 200.

As shown in FIG. 2, the features that form handle 215 include an elongate handle flap 213 formed in the reinforcing end flap 212 and foldably attached to the reinforcing end flap at a handle fold line 211 and separable from the reinforcing end flap 212 at a tear line 219. Alternatively, tear line 219 can be a series of cut lines. In the illustrated embodiment, the features of handle 215 include two oblique fold lines 207, 209 extending from the fold line 211 and a longitudinal fold line 217 for allowing deformation of the handle flap 213 when activating the handle 215. When the insert 200 is positioned onto blank 5, the elongate handle flap 213 is shaped and positioned so that the handle 215 is activated by pressing on the handle flap and folding the handle flap inwardly into the curved cutouts 29, 49 or 129, 149 to form the handle opening at one end in the carton 600. In one embodiment, the handle flap 213 is generally aligned with the handle flap 13 of the top end flap 12 when the carton 600 is erected and closed, and pressing on handle flap 13 activates handle flap 213.

The features of handle 315 includes an elongate handle flap 313 formed in reinforcing end flap 214 and foldably attached to the reinforcing end flap at a handle fold line 311 and separable from the reinforcing end flap 214 at a tear line 319. Alternatively, tear line 319 can be a series of cut lines. In the illustrated embodiment, the features of handle 315 include two oblique fold lines 307, 309 extending from the fold line 311 and a longitudinal fold line 317 for allowing deformation of the handle flap 313 when activating the handle 315. When the insert 200 is positioned onto blank 5, the elongate handle flap 313 is shaped and positioned so that the handle 315 is activated by pressing on the handle flap and folding the handle flap inwardly into the curved cutouts 29, 49 or 129, 149 to form the handle opening at one end in the carton 600. In one embodiment, the handle flap 313 is generally aligned with the handle flap 113 of the top end flap 14 when the carton 600 is erected and closed, and pressing on handle flap 113 activates handle flap 313.

The opening formed by handles 215 and 315 are shaped for insertion of a user's fingers during grasping of the carton 600. The handles 215 and 315 may be otherwise shaped and located in the carton 600 without departing from the scope of this disclosure. For example, the handle flaps 213, 313 can be omitted and handles 215, 315 can be handle openings. Handles 215 and 315 could have different features from one another without departing from the disclosure. Further, either handles 215 and 315 can be omitted without departing from the disclosure.

In the illustrated embodiment, the inner dispenser 270 is formed in the central panel 210 and in side flaps 250, 260 and generally corresponds to the outer dispenser 70 of blank 5. The inner dispenser 270 includes a first inner dispenser panel 282 and a second inner dispenser panel 284. The first dispenser panel 282 is separable from the carton 600 along an inner tear line 289 to further form the dispenser opening 500 (FIG. 12) in the carton 600. Each of the first and second inner dispenser panels 282, 284 is defined by tear line segments of the inner tear line 289, indicated at 271, 272, 273, 274, 275, 276, 277, 278, and 291. Tear line segments 272 can extend in an oblique direction with respect to longitudinal line L1 in side flap 250 to fold line 251 or in side flap 260 to fold line 261. Tear line segments 274 can extend into central panel 210 generally corresponding to an extension of tear line segments 272 from fold lines 251 and 261, respectively. Tear line segments 271 can extend generally parallel tear line segments 272 in side flaps 250 and 260 to fold lines 251, 261, respectively. Tear line segments 273 can extend from the intersections of the fold lines 251, 261 with tear line segments 271 to turn slightly and extend parallel to tear line segments 275 for a short distance. Tear line segments 275 can extend from the end points of tear line segments 274 generally parallel longitudinal line L1 to a turn near the midpoint of center panel 210. Center tear line segments 277, 291 can extend to form an arrowhead shaped ridge between the ends of tear line segments 275, with tear line segments 276, 278 extending to access panel or finger panel 280 as defined by breachable line 279. Tear line segments 271 and 273 are spaced from tear line segments 272 and 274, with the spacing between such tear line segments being substantially equal therealong. Alternatively, the tear line 89 with the series of tear line segments shown in FIG. 1 can be replaced with a single tear line, multiple segmented tear lines, or a series of cut lines, or can be otherwise shaped, arranged, and positioned without departing from the scope of this disclosure.

The central panel 210 can include an inner access panel or finger panel 280 at the center of the central panel 210. The inner finger panel 280 generally corresponds to outer finger panel 80 in carton blank 5. A tear line 279 is provided in central panel 210 that generally corresponds with the tear line 79 of the top panel 10. The center panel 210 also includes remainder portions 286 and 288 that extend between dispenser 270 and fold lines 295 and 293, respectively. The features of the insert blank 200 could be otherwise shaped and arranged without departing from this disclosure.

Figure 3:
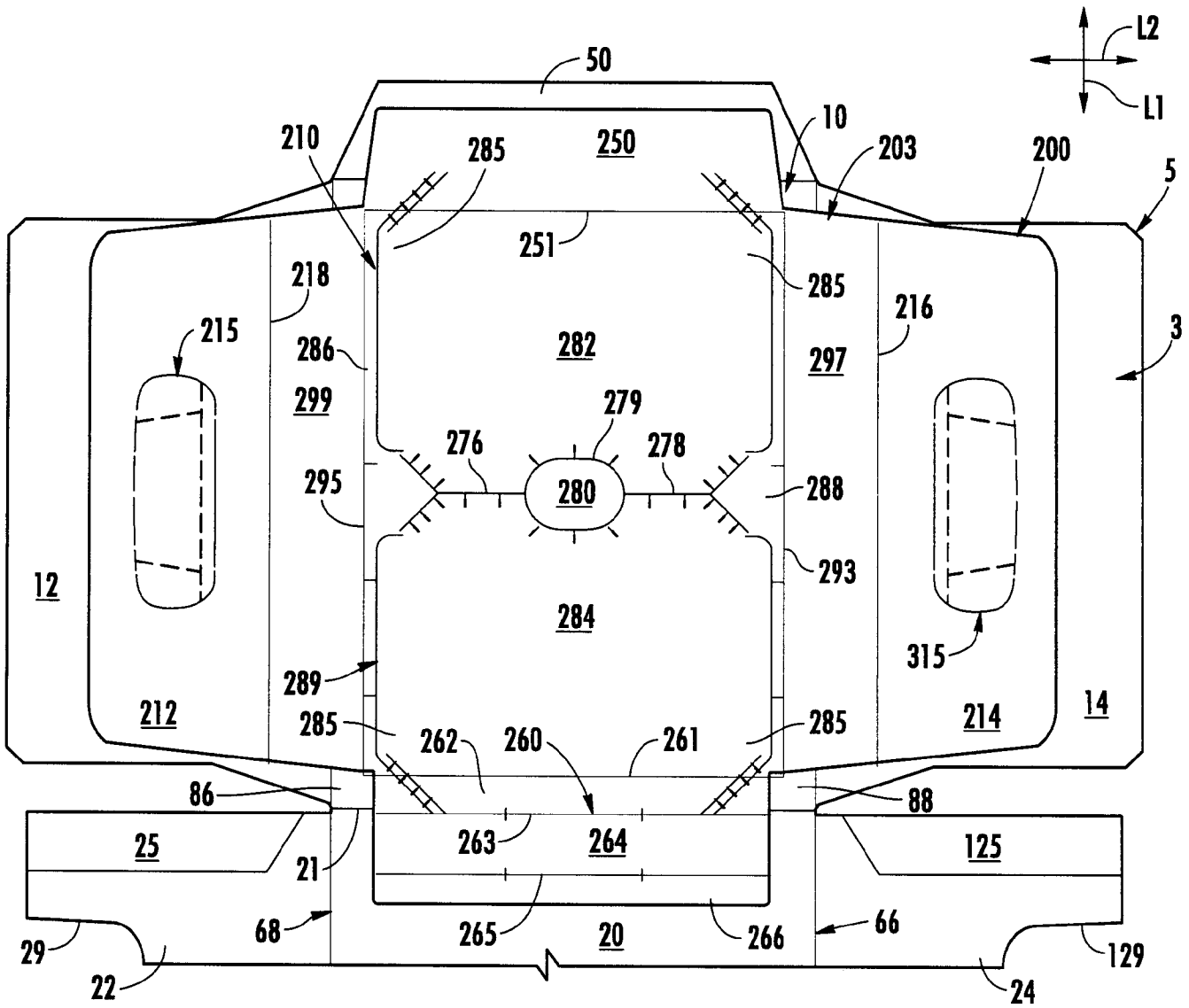
FIG. 3 is an interior plan view of the reinforcing insert overlaid on the carton blank.

As shown in FIG. 3, illustrating the interior surface 3 of the carton blank 5 and the interior surface 203 of the insert blank 200, the carton 600 is assembled by adhering the insert blank 200 to the top panel 10 of the carton blank 5. The insert blank 200 can be positioned on the carton blank 5 so that the inner finger panel 280 is generally concentric with the outer finger panel 80 in the top panel. The spacer panels 297, 299 generally overlay respective fold line segments 16, 18 of respective longitudinal fold lines 66, 68. The end flaps 212, 214 of the insert blank 200 are in generally face-to-face contact with portions of the respective top end flaps 12, 14 of the carton blank 5. The inner tear line 289 of the insert blank 200 can be generally positioned to correspond with and overlay portions of the outer tear line 89 of blank 5. The first inner dispenser panel 282 and second inner dispenser panel 284 of the insert blank 200 are in generally face-to-face contact with and are adhered to the respective first outer dispenser panel 82 and second outer dispenser panel 84 of blank 5. Generally, an adhesive, such as glue, can be applied, either to the exterior side 201 of the center panel 210 of insert 200 or to the interior side 3 (FIG. 3) of blank 5. The adhesive being applied only to surfaces corresponding with non-breachable lines, for example, with adhesive applied to the exterior 201 of insert 200 atop the inner remainder portions 286, 288, the inner dispenser panels 282, 284, and the inner finger panel 280, and can include sections of and the reinforcing side flaps 250, 260, or with adhesive applied to the interior 3 of blank 5 to the outer remainder portion 86, 88, the outer finger panel 80, and the outer dispenser panels 82, 84.

The tear line segments 275 of the inner tear line 289 extend beyond where the tear line segments 75, 175 intersect with the tear line segments 73, 173 of the outer tear line 89, under the upper remainder portions 86, 88 (FIGS. 3 and 12). The inner dispenser panels 282, 284 are wider than the respective outer dispenser panels 82, 84 where the tear line segments 275 extend under the upper remainder portions 86, 88 and thereby form retaining portions 285. The retaining portions 285 can interfere with the outer remainder portions 86, 88 of the top panel 10 and resist opening of the dispenser panels.

Figure 4:
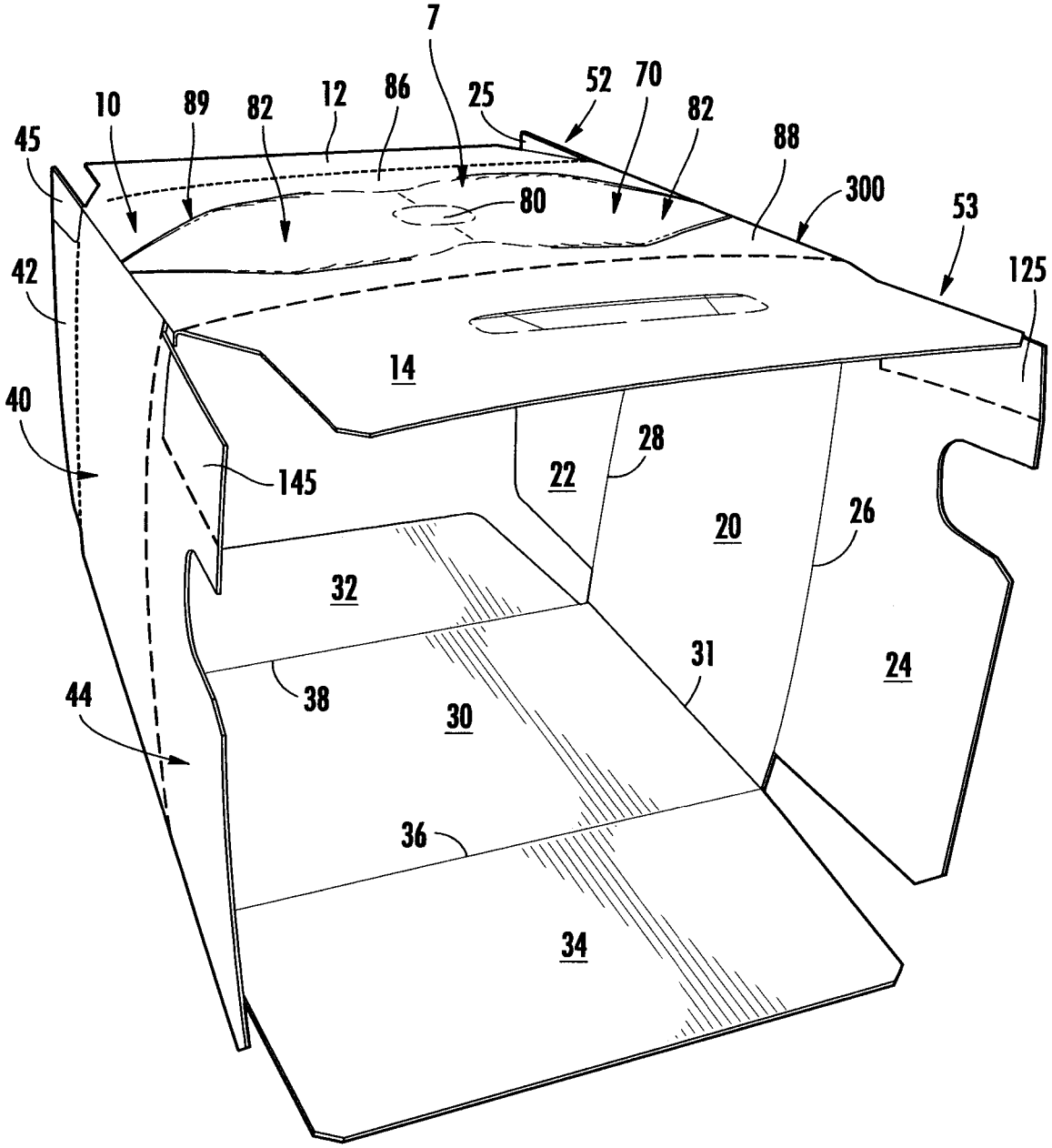
FIG. 4 is a perspective view showing the partially-erected carton in the form of a sleeve.
Figure 5:
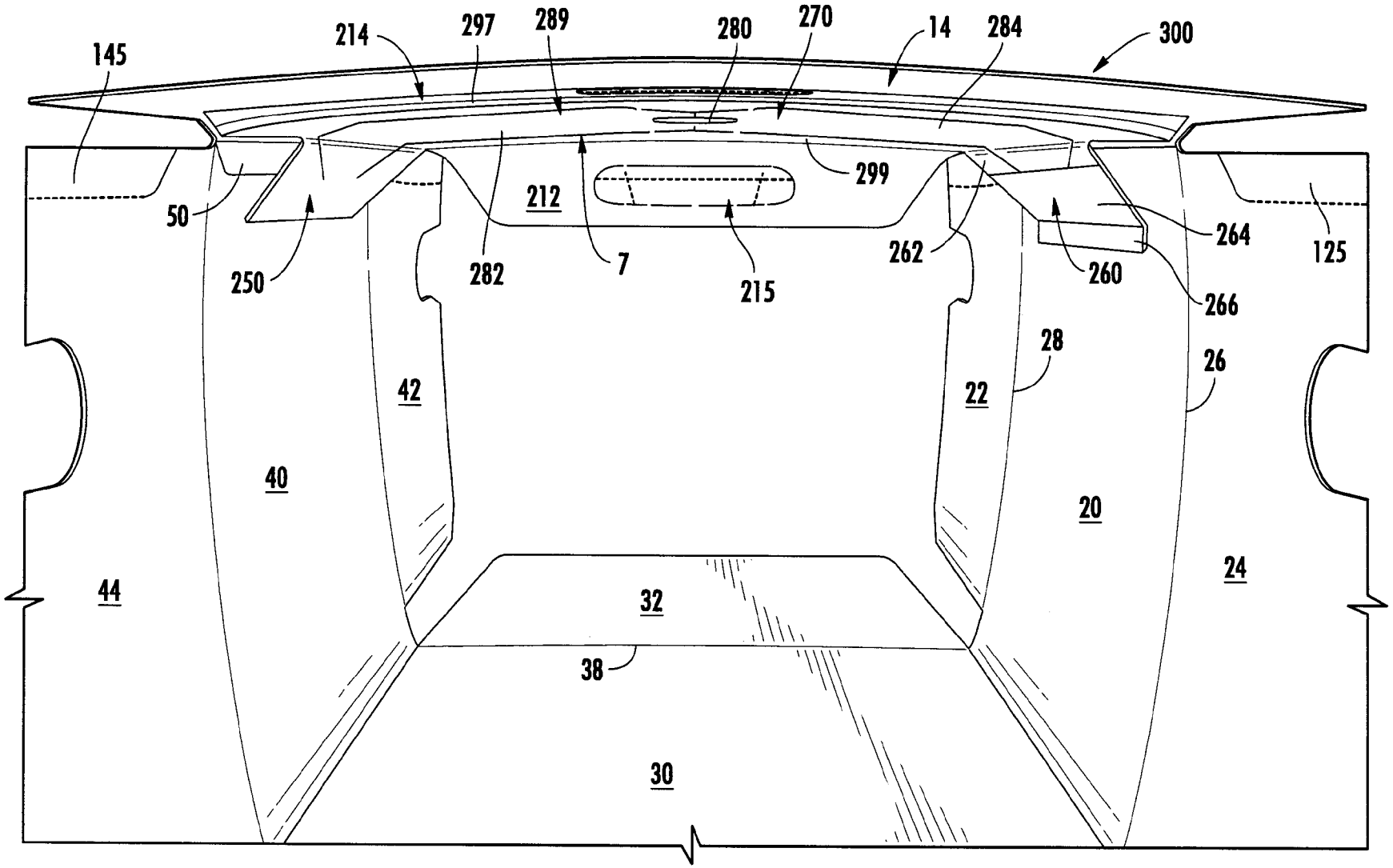
FIG. 5 is a perspective view showing an interior of the sleeve with the reinforcing insert.
Figure 6:
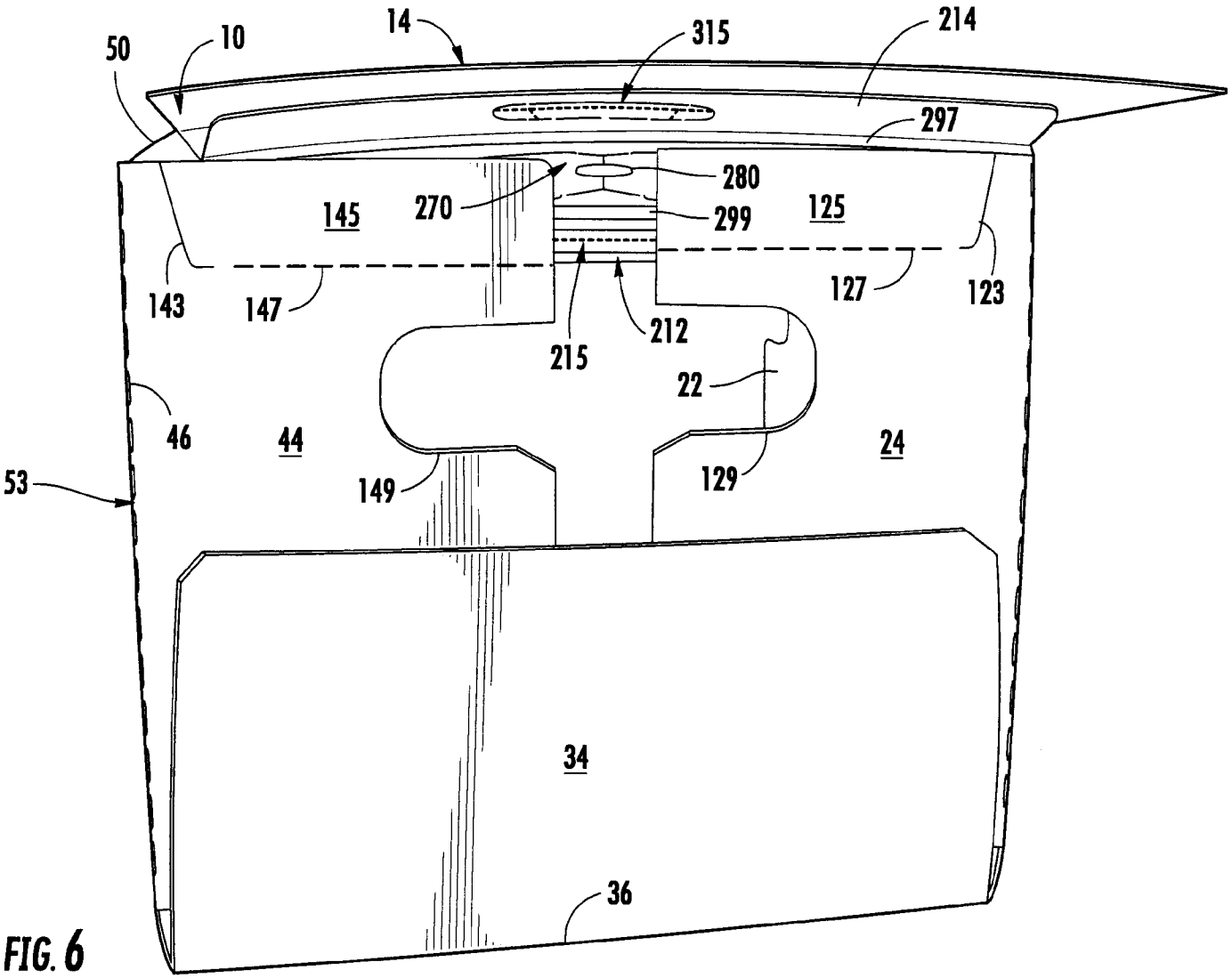
FIG. 6-9 show the closing of an end of the carton by overlapping the end flaps of the carton and the reinforcing insert.
Figure 7:
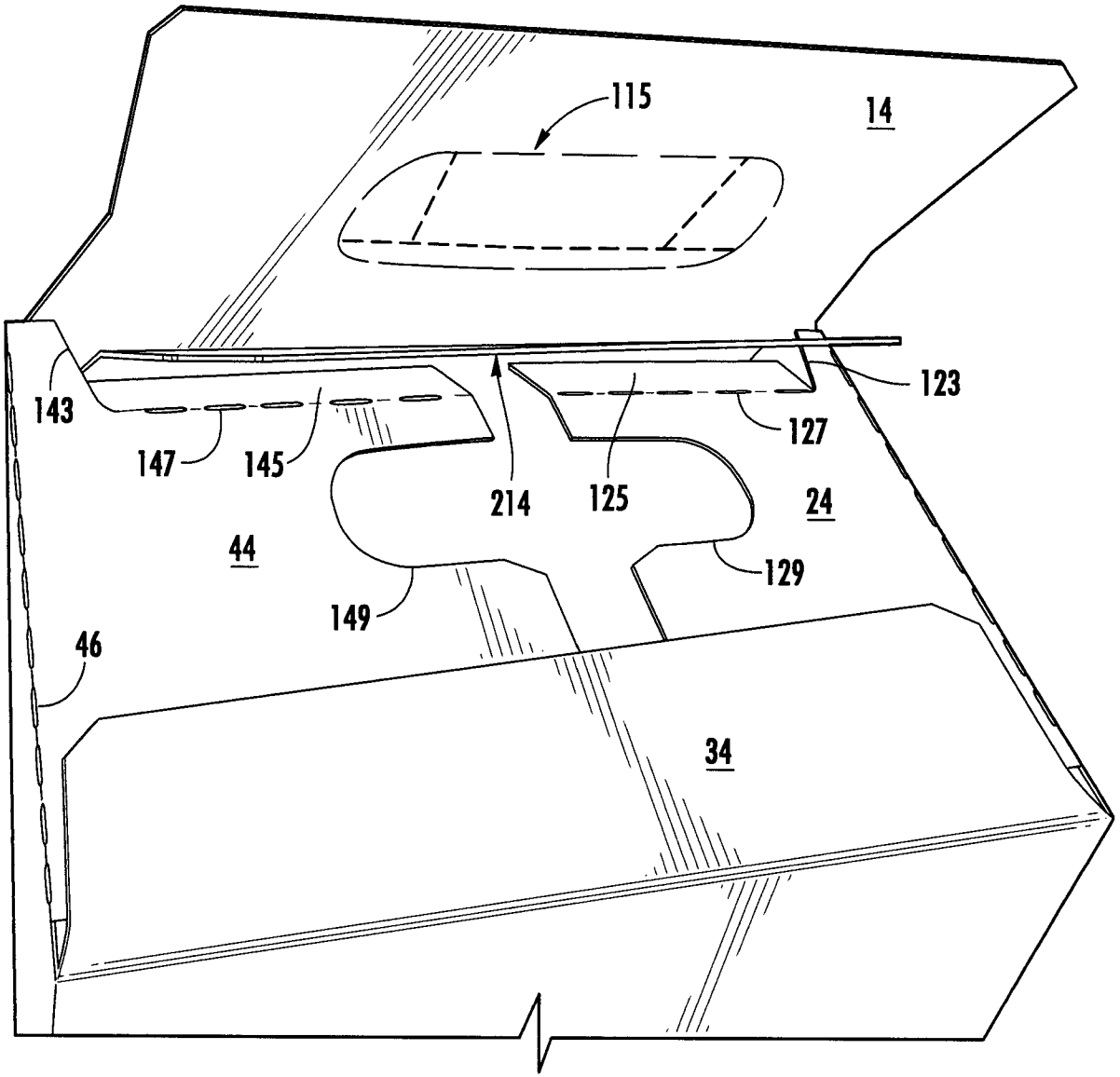
Figure 8:
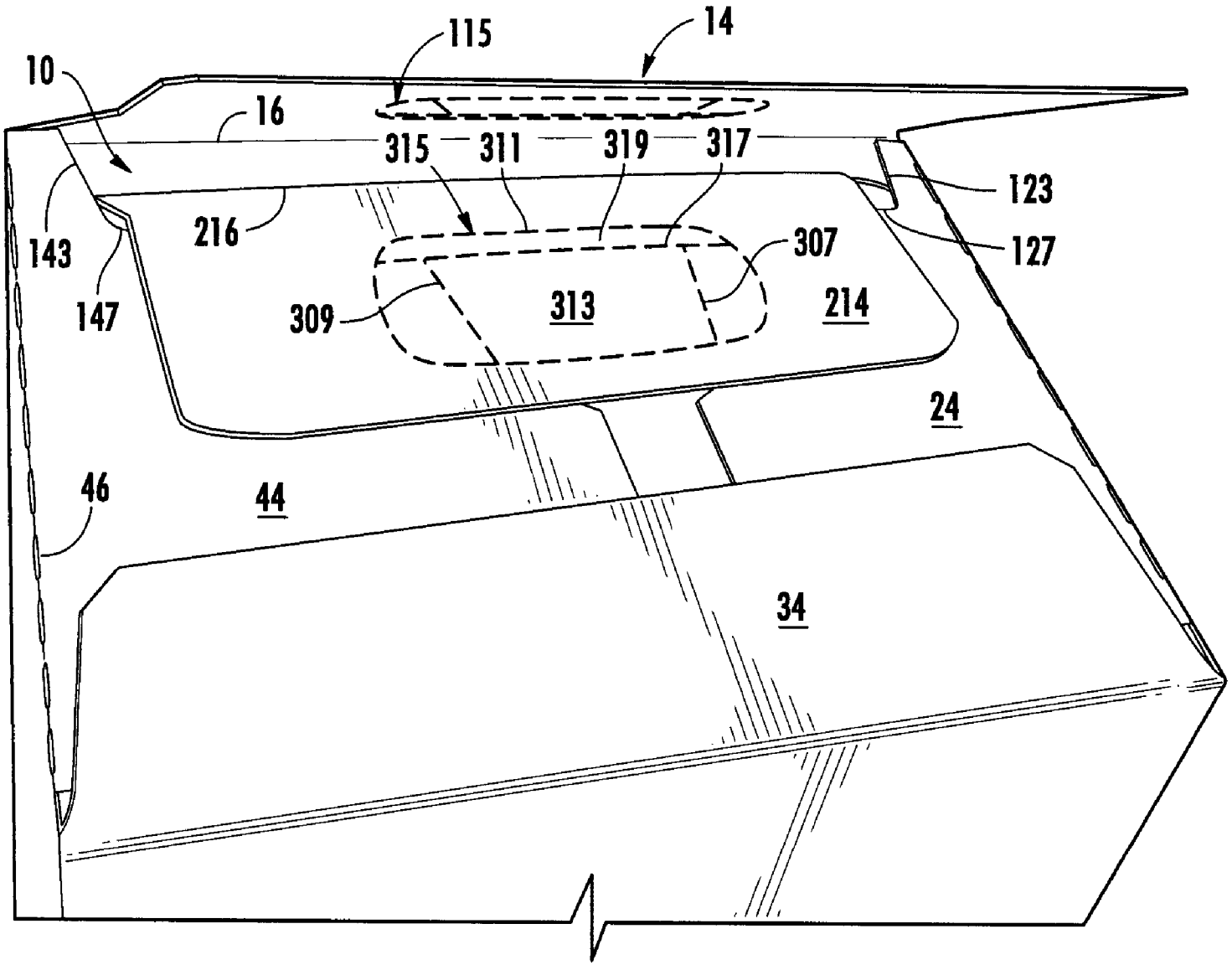

In accordance with the exemplary embodiment, the carton blank 5 with insert blank 200 adhered thereto can be erected into carton 600 by folding along fold lines 21, 31, 41, and 51 and adhering the adhesive flap 50 to the second side panel 40 to form a sleeve 300 (FIGS. 4 and 5). Carton blank 5 may be otherwise configured to have multiple top panels, multiple bottom panels, multiple side panels, or combinations thereof without departing from the scope of this disclosure.

As shown in FIG. 5, the reinforcing side flaps 250, 260 are pivoted downwardly by the respective side panels 40, 20 as the sleeve 300 is formed. The reinforcing side flaps 250, 260 extend in an oblique direction from the top panel 10 to the respective side panels 40, 20 to form angled corners between the side panels and the top panel.

Figure 10:
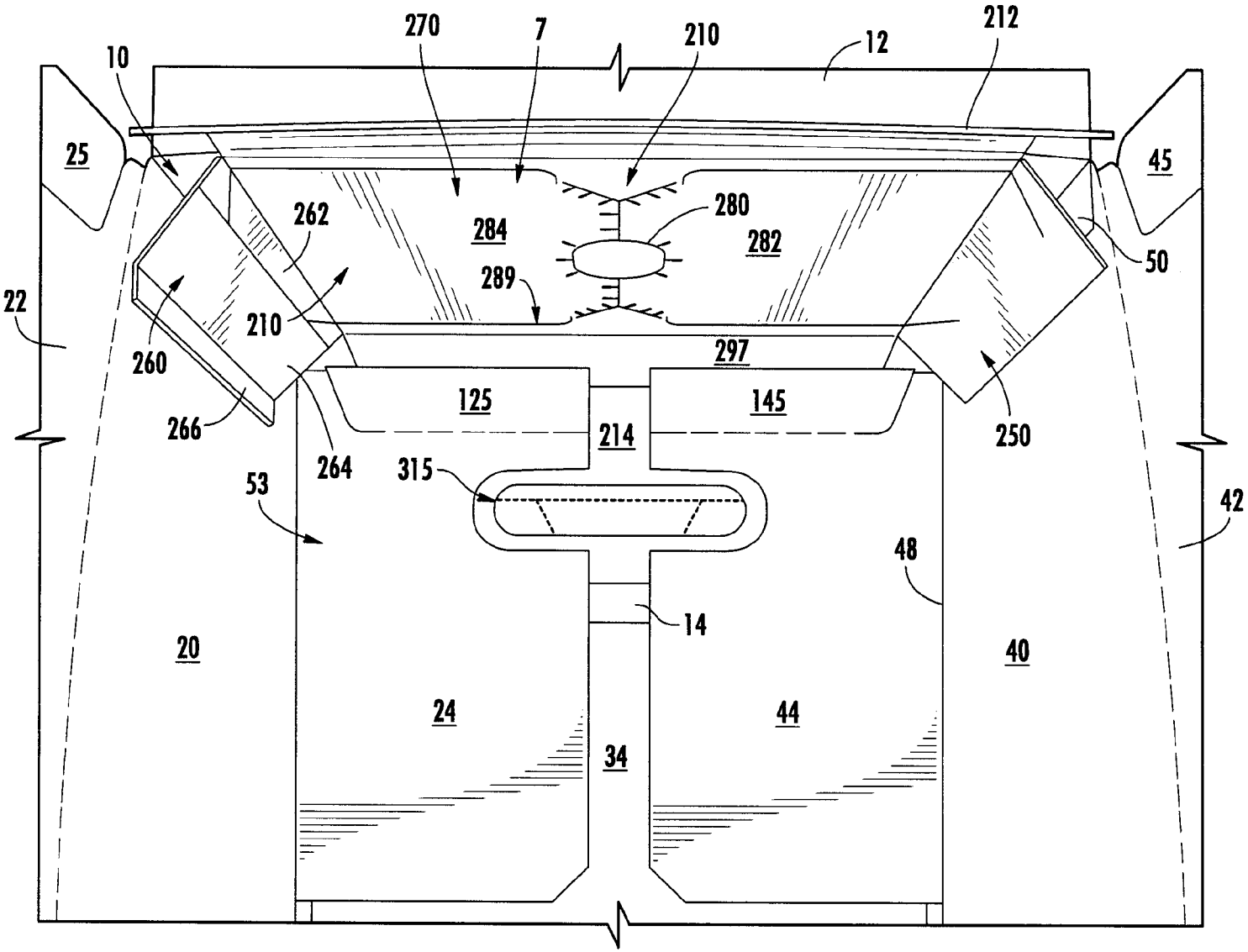
FIG. 10 shows the interior of the carton housing the reinforcing insert with a closed end of the carton.

As shown in FIGS. 6-9, the second end 53 of the carton 600 is closed by respectively overlapping and adhering the side end flaps 24, 44 and the top and bottom end flaps 14, 34. Since the insert blank 200 is not attached to flap 14, folding of flap 14 along fold line 16 folds spacer panel 297 along fold line 293 and end flap 214 along fold line 216. The end flap 214 can be adhered to the exterior surfaces of the side end flaps 24, 44 after the folding of the top end flap 14 and the reinforcing end flap 214 so that the handle 315 is generally aligned with the handle 115 and the handle cut outs 129, 149. The spacer panel 297 forms a tent structure over the upper flaps 125 and 145 to pivot the flaps 125 and 145 toward the interior of carton 600 (FIGS. 7, 8, and 10) with the spacer panel 297 extending at an oblique angle between the top panel 10 and the side end flaps 24, 44, thereby forming an angled corner at the second end 53.

In the illustrated embodiment, the first end 52 has similar features as the second end 53 and can be closed in substantially the same manner as the second end 53. The closed first end 52 is shown in FIG. 11. The first end 52 of the carton 600 can be closed by respectively overlapping and adhering the side end flaps 22, 42 and top and bottom end flaps 12, 32. Since the insert blank 200 is not attached to flap 12, folding of flap 12 along fold line 18 folds the spacer panel 299 along fold line 295 and flap 212 along fold line 218. The spacer panel 299 forms a tent structure over the upper flaps 25 and 45 to pivot the flaps 25 and 45 toward the interior of carton 600, thereby forming an angled corner at the first end 52. Alternatively, the first end 52 can be otherwise configured or closed in a different manner than the second end 53 without departing from the scope of this disclosure.

Inside the erected and closed carton 600, the tent structure, including the angled corners formed between the top panel 10 and the side panels 40, 20 by the reinforcing side flaps 250, 260 and the angled corners formed between the top panel 10 and the ends 52, 53 by the reinforcing end flaps 212, 214, defines interior corners that are chamfered or angled rather than square. This, in turn, helps to hold the bottles in place and prevents them from jostling around excessively.

The top end flaps 12, 14, the upper portions of side end flaps 24 and 44, and the reinforcing end flaps 212, 214 provide three layers of material above each handle 15, 115 with the reinforcing end flaps 212, 214 in face-to-face contact with an interior surface of the respective top end flaps 12, 14, and in face-to-face contact with an exterior surface of the side end flaps 22, 42 and side end flaps 24, 44.

Once the blank 5 is formed into the sleeve 300, the containers C may be loaded in the carton 600 from the first end 52 and then the first end 52 may be closed by overlapping and gluing the side end flaps 42, 44 and top and bottom end flaps 14, 34, and then the second end 53 may be closed by overlapping and gluing the side end flaps 22, 42 and top and bottom end flaps 12, 32. The assembled carton 600 is shown in FIG. 12. Alternative assembling, loading, and closing steps may be used without departing from the scope of this disclosure.

The handle 15 can be used to grasp the carton 600 by pressing against the elongate handle flap 13, which contacts the aligned handle flap 213 to pivot the handle flaps 13, 213 inwardly to create a handle opening in the closed first end 52 of the carton 600. Similarly, the handle 115 can be used to grasp the carton 600 at the closed second end 53. The reinforcing end flaps 212, 214 of the reinforcing insert provide an extra layer of material above each handle 15, 115 to reinforce the carton 600 by increasing the strength and rigidity of the carton to prevent tearing or other failure when the carton is lifted at the handles. It is understood that the carton 600 may have one handle or no handles or that the handles 15, 115 can be otherwise shaped, arranged, and/or located without departing from the disclosure. When the carton 600 is closed and the handle 15 or 115 is activated for grasping of the carton, the handle flap 13, 113 can be folded inward along fold line 11, 111 to pivot the respective handle flaps 213, 313 inwardly to be in opposing face-to-face relation with the interior surface of the upper portions of the respective side end flaps 22, 42 or 24, 44. Other opening arrangements for the handles 15, 115 can be provided without departing from the scope of this disclosure.

As shown in FIG. 12, the carton 600 can be opened by actuating the dispenser 7 to create a dispenser opening 500 in the top panel 10 of the carton 600. The dispenser 7 is opened by first removing the finger panels 80, 280 by pressing and tearing the carton at tear lines 79, 279. As shown in FIG. 12, the dispenser 7 is further opened by tearing along tear lines 89, 289 and upwardly folding the first dispenser panels 82, 282. The retaining portions 285 of the first inner dispenser panel 282 are folded inwardly somewhat by the remainder portions 86, 88 as the dispenser panels 82, 282 are pivoted upwardly. The second dispenser panels 84, 284 can be opened in a similar manner by tearing along tear lines 89, 289. Since the first outer dispenser panel 82 is adhered to the first inner dispenser panel 282 of the reinforcement insert 200, the inner dispenser panel 282 forms an inner layer of material and the outer dispenser panel 82 forms an outer layer of material of the dispenser flap. Since the second outer dispenser panel 84 is adhered to the second inner dispenser panel 284 of the reinforcement insert 200, the inner dispenser panel 284 forms an inner layer of material and the outer dispenser panel 84 forms an outer layer of material of the dispenser flap. As shown in FIG. 12, the shape of the tear line segments 77, 177 in the top panel 10 creates two retention tabs 501, 502 at opposite ends of the dispenser opening 500. Further, top edges (503 shown in FIG. 12) are formed at the top panel 10 at the opening 500. Other opening arrangements for the dispenser 7 can be provided without departing from the scope of this disclosure.

In the illustrated embodiment, the dispenser 7 can be closed by downwardly folding the first dispenser panels 82, 282 adjacent the retention tabs 501, 502 in a downwardly folded position. Further, retaining portions 285 of the inner dispenser panels 282, 284 are generally wider than the outer dispenser panels 82, 84 where the tear line segments 275 extend under the outer remainder portions 86, 88. The retaining portions 285 can interfere with the outer remainder portions 86, 88 to retain the dispenser panels in a closed position. The dispenser 7 thus resists reopening. Other closing arrangements and retention mechanisms for the dispenser 7 can be provided without departing from the scope of this disclosure.

Figure 13:
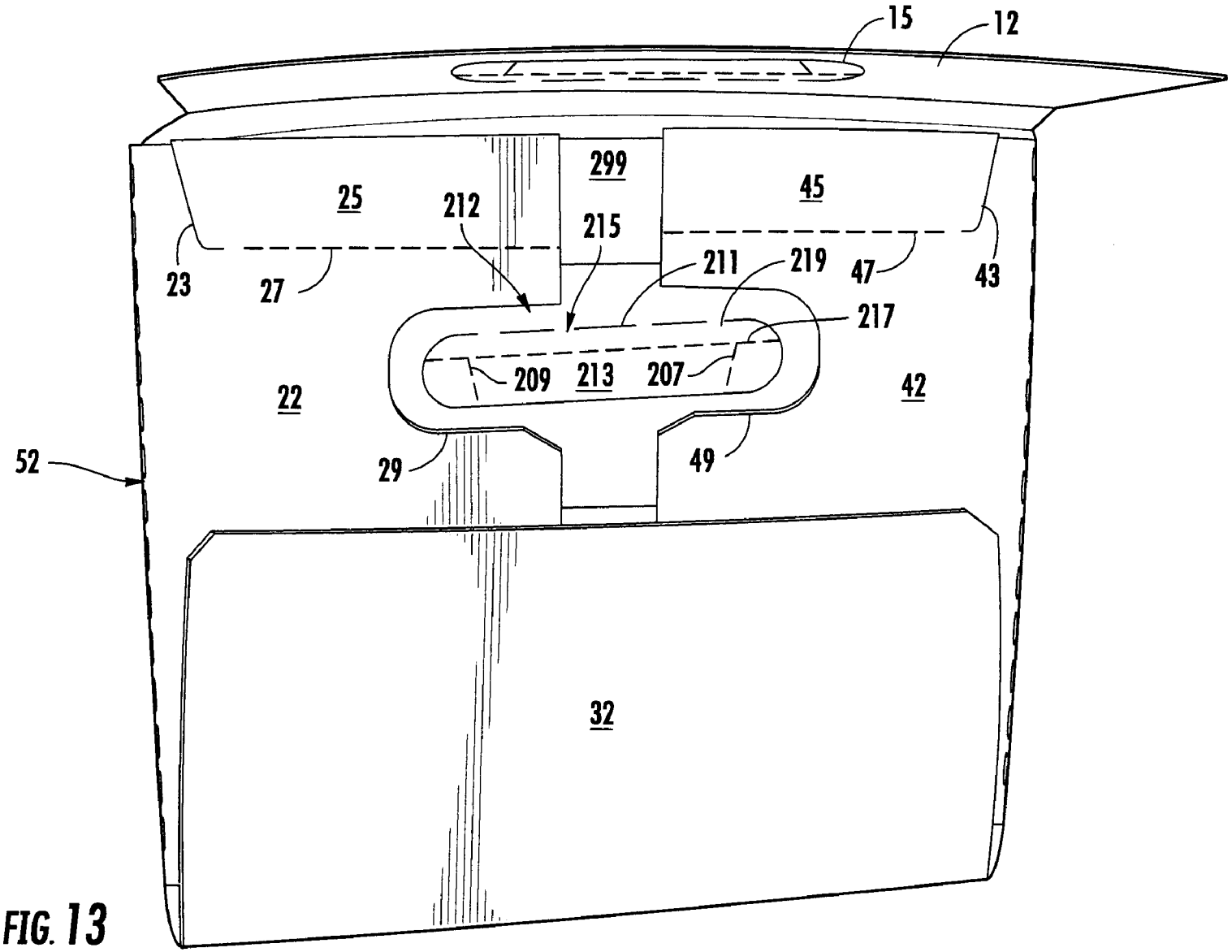
FIG. 13 shows an alternate orientation of the carton with an end flap of the reinforcing insert disposed behind the side end flaps.

FIG. 13 shows an alternate orientation of the carton with the first embodiment insert blank disposed behind the side end flaps. In the orientation shown in FIG. 13, the insert panel is secured in position by the carton 600 and the containers C. The reinforcing end flaps 212, 214 can be adhered to the inner surfaces of the side end flaps 22, 42 or 24, 44, and the top end flaps 12, 14 can be adhered to the outer surfaces of the side end flaps 22, 42 or 24, 44. This alternate configuration folds panel 297 into position to secure the top portion of containers C.

Figure 14:
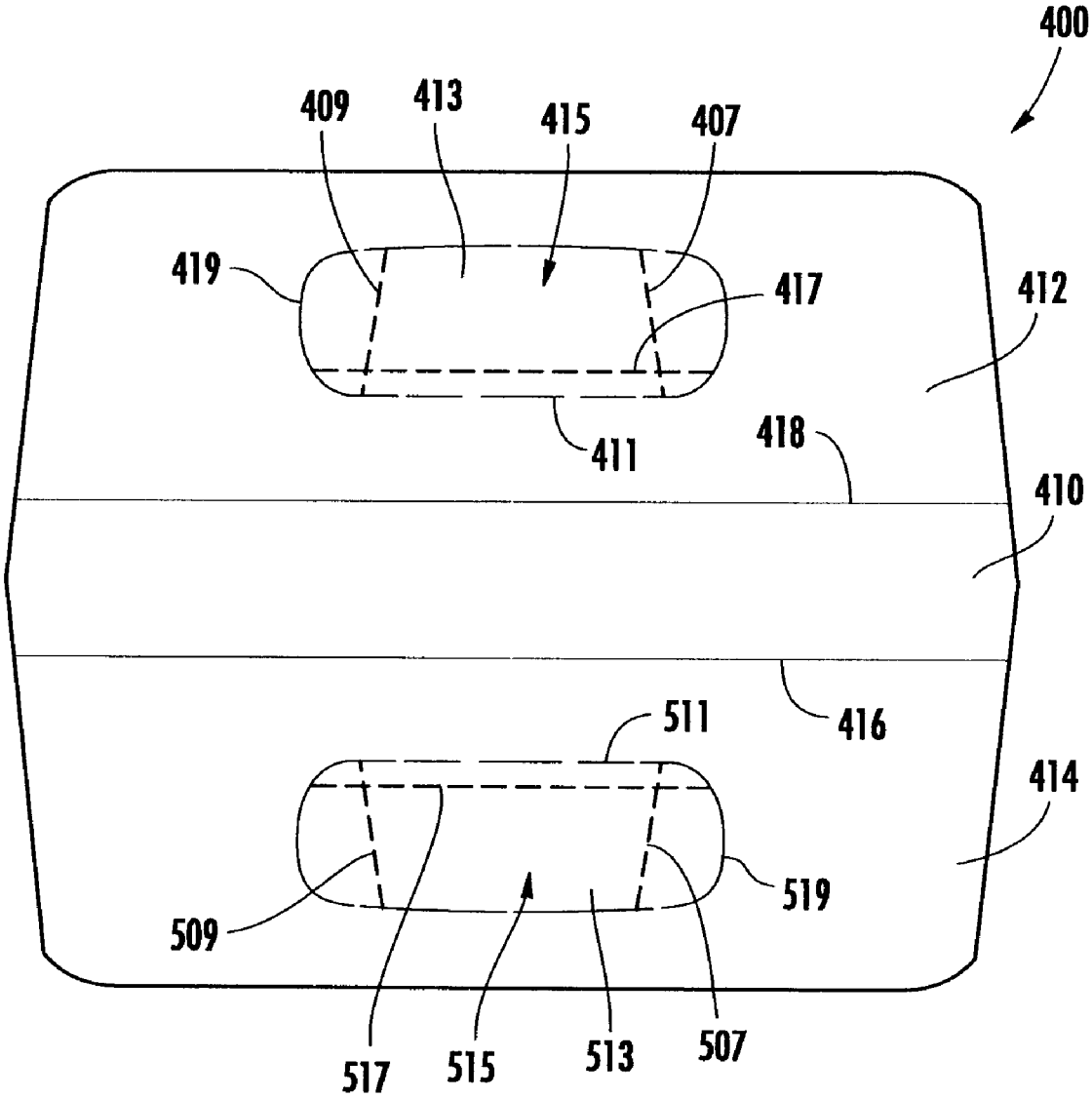
FIG. 14 is a plan view of an alternative insert blank used to form a reinforcing insert for the carton according to a second embodiment of the disclosure.

FIG. 14 shows a second insert blank 400 used to form a reinforcing insert (FIG. 15) for use in carton 600. Insert blank 400 includes a central panel or spacer panel 410 and two end flaps 412, 414. Each end flap 412, 414 is respectively, independently foldable relative to the spacer panel 410 along respective fold lines 418, 416. These fold lines 418, 416 could be otherwise shaped, arranged, and located (e.g., could comprise areas of weakening) without departing from the scope of this disclosure. Each end flap 412, 414 includes a handle 415, 515 respectively, which generally correspond to handles 15, 115.

Figure 16:
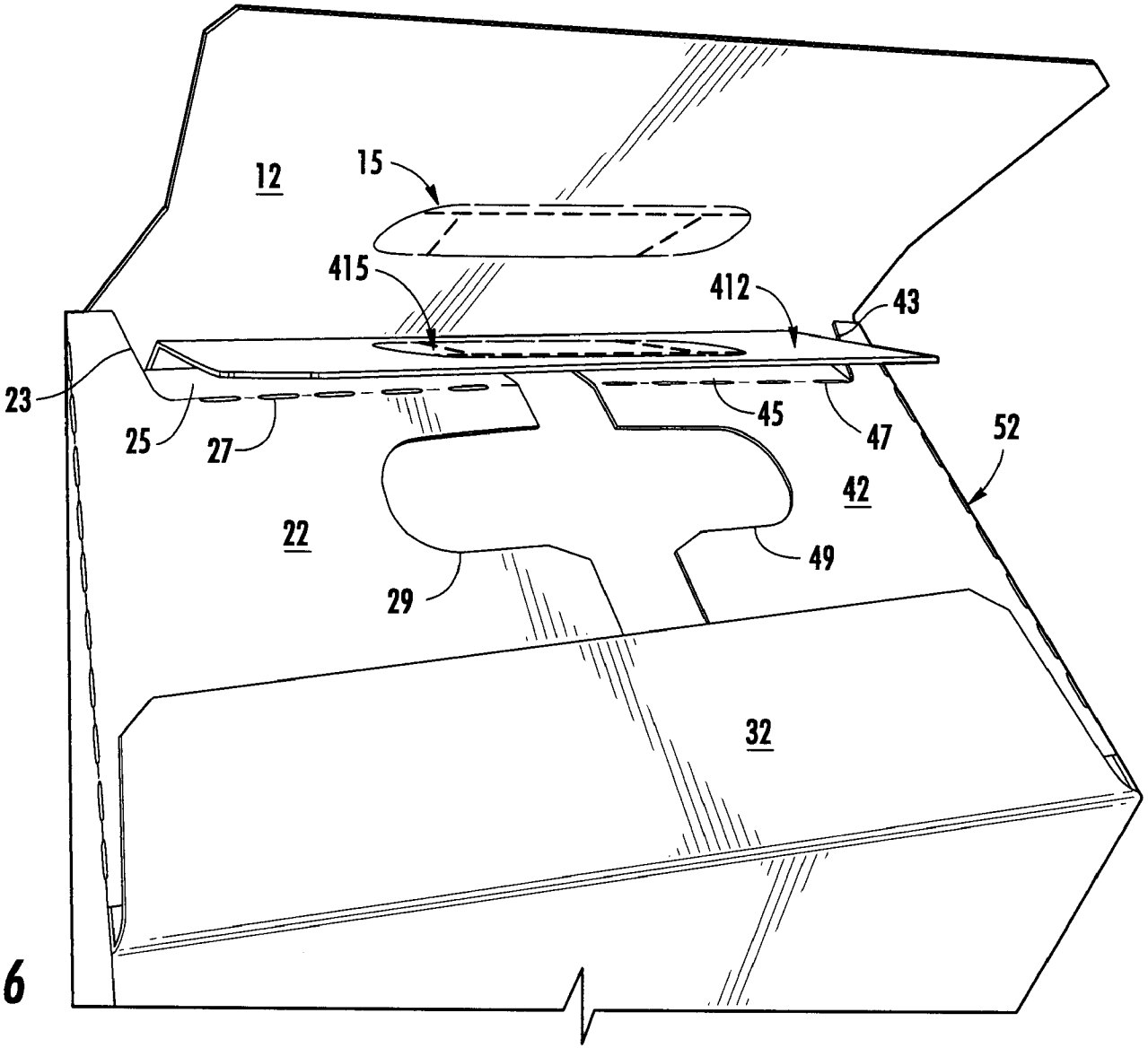
FIG. 16 shows the closing of an end of the carton by overlapping the end flaps of the carton and the reinforcing insert of FIG. 14.

As shown in FIG. 16, the features that form handle 415 include an elongate handle flap 413 formed in the reinforcing end flap 412 and foldably attached to the reinforcing end flap at a handle fold line 411 and separable from the reinforcing end flap 412 at a tear line 419. Alternatively, tear line 419 can be a series of cut lines. In the illustrated embodiment, the features of handle 415 include two oblique fold lines 407, 409 extending from the fold line 411 and a longitudinal fold line 417 for allowing deformation of the handle flap 413 when activating the handle 415. When the insert 400 is positioned onto blank 5, the elongate handle flap 413 is shaped and positioned so that the handle 415 is activated by pressing on the handle flap and folding the handle flap inwardly into the curved cutouts 29, 49 or 129, 149 to form the handle opening at one end in the carton 600.

Handle 515 includes an elongate handle flap 513 formed in the reinforcing end flap 414 and foldably attached to the reinforcing end flap at a handle fold line 511 and separable from the reinforcing end flap 414 at a tear line 519. Alternatively, tear line 519 can be a series of cut lines. In the illustrated embodiment, the features of handle 515 include two oblique fold lines 507, 509 extending from the fold line 511 and a longitudinal fold line 517 for allowing deformation of the handle flap 513 when activating the handle 515. When the insert 400 is positioned onto blank 5, the elongate handle flap 513 is shaped and positioned so that the handle 515 is activated by pressing on the handle flap and folding the handle flap inwardly into the curved cutouts 29, 49 or 129, 149 to form the handle opening at one end in the carton 600.

The opening formed by handles 415 and 515 are shaped for insertion of a user's fingers during grasping of the carton 600. The handles 415 and 515 may be otherwise shaped and located in the carton 600 without departing from the scope of this disclosure. Handles 415 and 515 could have different features from one another without departing from the disclosure. Further, either handles 415 and 515 can be omitted without departing from the disclosure.

Figure 15:
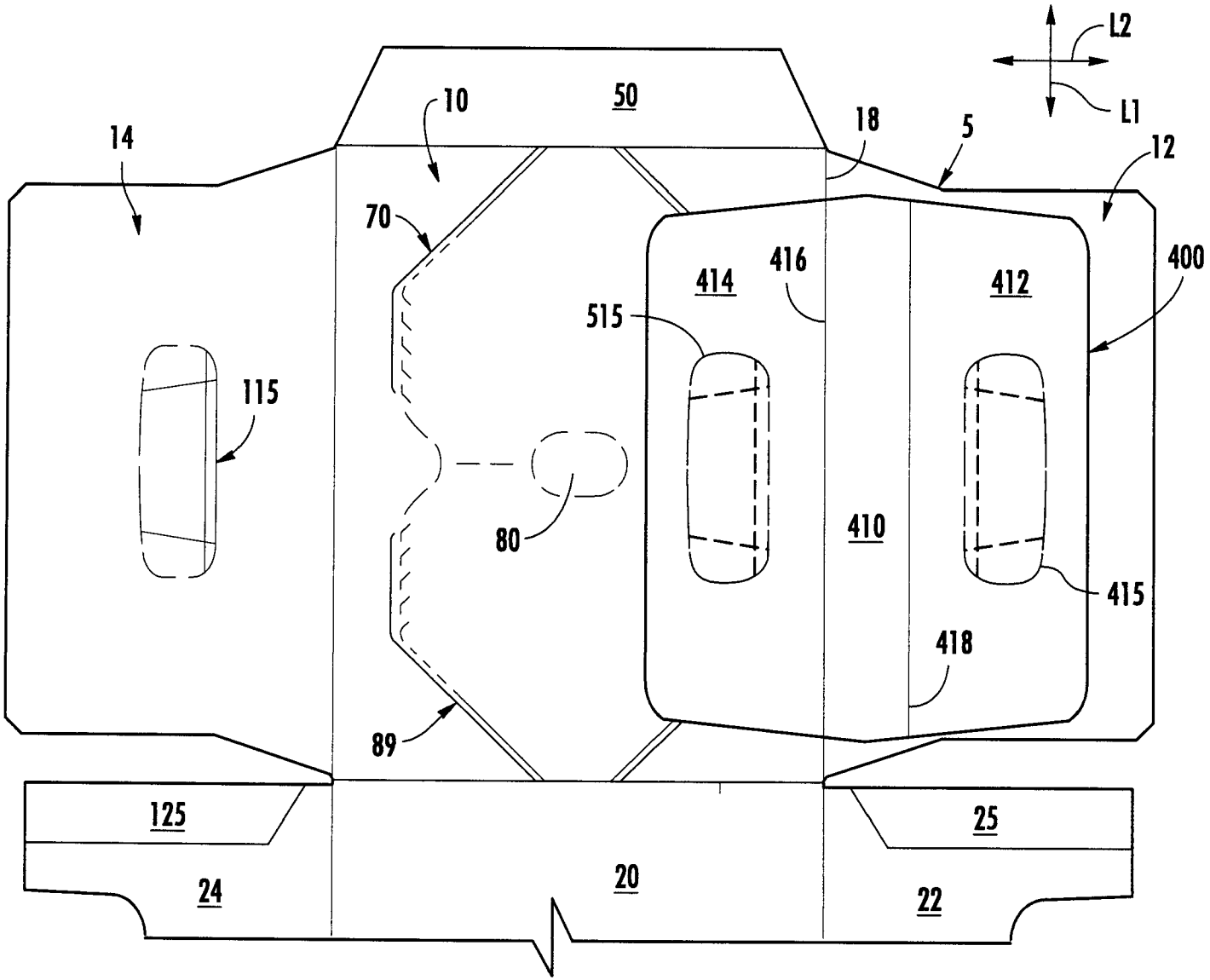
FIG. 15 is a plan view of the insert blank of FIG. 14 overlaid on the carton blank.

FIG. 15 is a plan view of the second insert blank 400 overlaid on the carton blank 5. Further, since insert blank 400 is symmetrical about a center line passing through the center of spacer panel 410, either flap (412 or 414) can be positioned and adhered to the interior of blank 5, with the other flap (412 or 414) disposed in a position corresponding to either the first end 52 or second end 53 of carton 600. In position, either handle 415 or 515 will be positioned to correspond to handle 15 or 115 of blank 5. In addition, a first reinforcing insert 400 can be included at the first end 52 and a second reinforcing insert 400 can be included at the second end 53.

Figure 17:
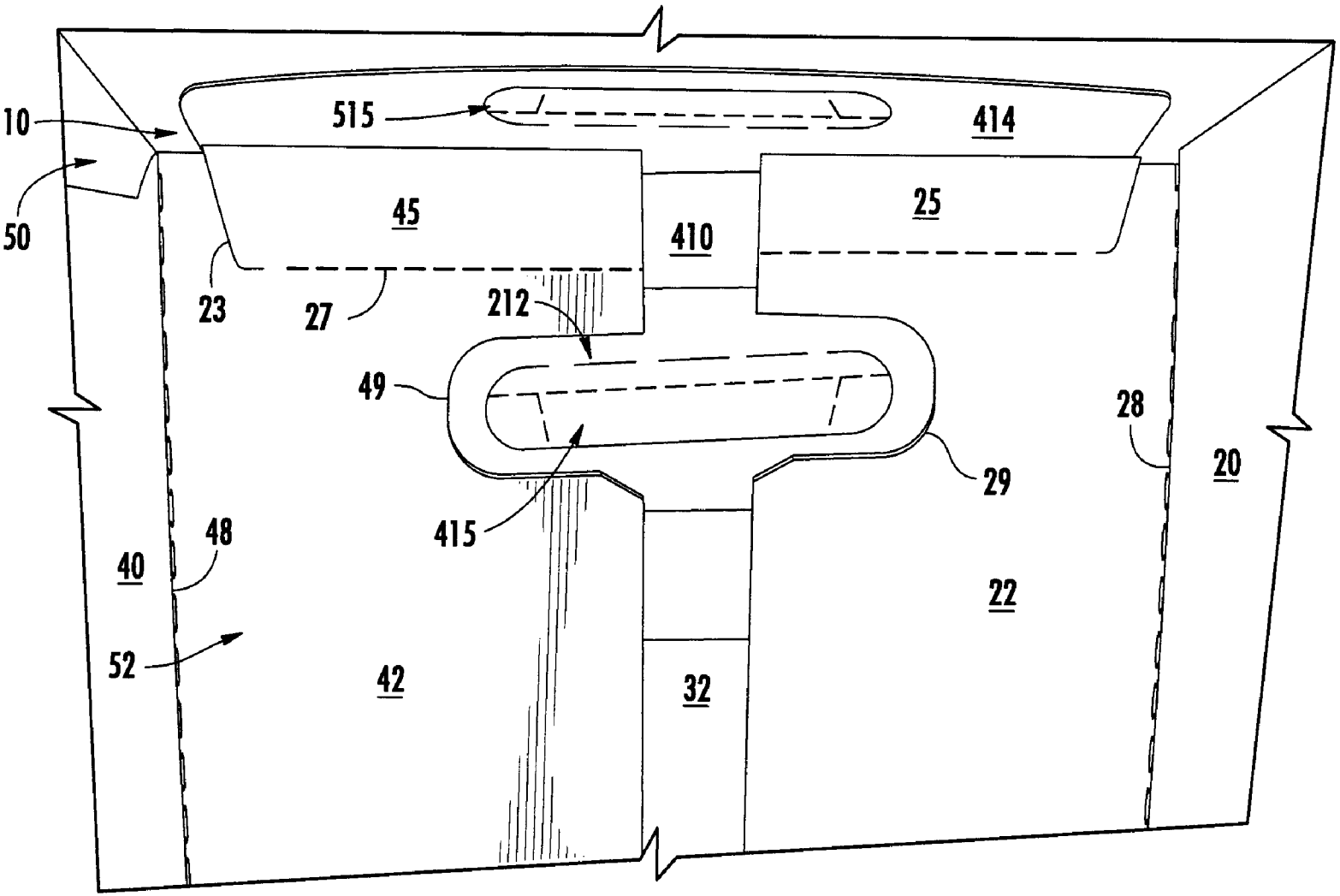
FIG. 17 shows the interior of the carton with the reinforcing insert of FIG. 14 attached and with a closed end of the carton.

FIG. 16 shows the second embodiment insert blank of FIG. 14 folding the upper flaps 25, 45 of the side end flaps 22, 42 at the first end 52 into the carton interior. The flap that is not adhered to the top panel 10 (either 412 or 414) is substantially similar to the features of flap 212 or 214, with spacer panel 410 acting similar to spacer panels 297, 299 to form a tent structure that forces the upper portions 25, 45 into the interior of the carton when flap 12 is folded into position to close the first end 52. FIG. 17 shows the first end 52 from the interior of the carton with the second insert blank 400 in place with the first end closed. Alternatively still, the second insert blank 400 could be positioned in the alternate position of first insert blank 200 shown in FIG. 13.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprising a top panel, a bottom panel, a first side panel, and a second side panel;

at least two end flaps respectively foldably attached to respective panels of the plurality of panels, the at least two end flaps being overlapped with respect to one another to thereby at least partially form a closed end of the carton, wherein the at least two end flaps comprises at least one side end flap foldably connected to at least the first side panel or the second side panel, the at least one side end flap comprising an upper flap;

a reinforcing insert comprising a central panel at least partially in face-to-face contact with the top panel, at least one reinforcing end flap at least partially in face-to-face contact with at least one of the at least two end flaps, at least one reinforcing side flap foldably connected to the central panel, and at least one spacer panel foldably connected to the central panel and the at least one reinforcing end flap, the at least one spacer panel extending in an oblique direction with respect to the top panel, wherein the upper flap of the at least one side end flap at least partially engages the at least one spacer panel;

a dispenser for allowing access to the articles in the carton, the dispenser comprising at least a portion of the top panel and at least a portion of the central panel.

2. The carton of claim 1, wherein the at least one reinforcing side flap comprises a first reinforcing side flap and a second reinforcing side flap, wherein each of the first and second reinforcing side flaps extends in an oblique direction with respect to the top panel and comprises an edge adjacent the respective first and second side panels.

3. The carton of claim 1, wherein the at least one reinforcing end flap is at least partially in face-to-face contact with an exterior surface of the at least one side end flap and the at least one spacer panel is at least partially in face-to-face contact with the upper flap of the at least one side end flap.

4. The carton of claim 3, wherein the at least one side end flap comprises at least one lateral edge adjacent the top panel, and the upper flap of the at least one side end flap is at least partially defined by a fold line that is spaced apart from the at least one lateral edge of the at least one side end flap.

5. The carton of claim 4, wherein the at least one side end flap comprises a first side end flap foldably connected to the first side panel and a second side end flap foldably connected to the second side panel, the upper flap of each of the first and second side end flaps being at least partially in face-to-face contact with the at least one spacer panel, and the at least one lateral edge of each of the first and second side end flaps is disposed closer to the top panel than the upper flaps.

6. The carton of claim 5, wherein the at least one end flap further comprises a top end flap, and the reinforcing end flap is at least partially in face-to-face contact with an interior surface of the top end flap.

7. The carton of claim 1, wherein the at least one reinforcing end flap is at least partially in face-to-face contact with an interior surface of the at least one side end flap.

8. The carton of claim 1, wherein the at least two end flaps comprise at least two first end flaps and the closed end is a closed first end of the carton, and the carton further comprises at least two second end flaps that are overlapped with respect to one another to thereby at least partially form a closed second end of the carton, the at least one reinforcing end flap comprises a first reinforcing end flap at least partially in face-to-face contact with at least one of the at least two first end flaps and a second reinforcing end flap at least partially in face-to-face contact with at least one of the at least two second end flaps.

9. The carton of claim 1, wherein the at least two end flaps and the at least one reinforcing end flap comprise handle features for forming a handle in the closed end of the carton.

10. The carton of claim 9, wherein the at least two end flaps further comprises a top end flap, and the handle features comprise a handle cutout extending in the at least one side end flap, an inner handle flap foldably connected to the at least one reinforcing end flap along a first fold line, and an outer handle flap foldably connected to the top end flap along a second fold line, at least a portion of the inner handle flap being aligned with the handle cutout and the outer handle flap.

11. The carton of claim 10, wherein at least a portion of the upper flap of the at least one side end flap is disposed between the handle cutout and the top panel.

12. The carton of claim 1, wherein the dispenser comprises at least one outer dispenser panel at least partially defined by an outer tear line extending in at least the top panel and at least one inner dispenser panel at least partially defined by an inner tear line extending in at least the central panel.

13. The carton of claim 12, wherein the dispenser further comprises an outer finger panel extending in at least the top panel adjacent the at least one outer dispenser panel and an inner finger panel extending in at least the central panel adjacent the at least one inner dispenser panel, the inner finger panel being generally aligned with the outer finger panel.

14. The carton of claim 13, wherein the at least one outer dispenser panel comprises a first outer dispenser panel adjacent a second outer dispenser panel with the outer finger panel disposed therebetween, and the at least one inner dispenser panel comprises a first inner dispenser panel adjacent a second inner dispenser panel with the inner finger panel disposed therebetween.

15. The carton of claim 12, wherein the at least one outer dispenser panel is connected to at least one panel of the plurality of panels along a lateral fold line, and the outer tear line comprises a first outer oblique segment extending from a first end of the lateral fold line, a first outer longitudinal segment extending from the first outer oblique segment, a second outer oblique segment extending from a second end of the lateral fold line, and a second outer longitudinal segment extending from the second outer oblique segment.

16. The carton of claim 15, wherein the inner tear line comprises a first inner oblique segment extending in the at least one reinforcing side flap and the central panel, a first inner longitudinal segment extending from an end of the first inner oblique segment in the central panel, a second oblique segment extending in the at least one reinforcing side flap and the central panel, and a second inner longitudinal segment extending from an end of the second inner oblique segment in the central panel, at least a portion of each of the first and second inner longitudinal segments being generally aligned with the respective first and second outer longitudinal segments of the outer tear line.

17. The carton of claim 16, wherein each of the first and second inner longitudinal segments of the inner tear line is longer than the respective first and second outer longitudinal segments of the outer tear line so that at least a portion of the at least one inner dispenser panel is wider than an adjacent portion of the at least one outer dispenser panel at least partially defined between the first and second outer oblique segments of the outer tear line.

18. The carton of claim 12, wherein the top panel comprises at least one remainder portion disposed between the at least one outer dispenser panel and the closed end of the carton, at least a portion of the at least one inner dispenser panel being in face-to-face contact with the remainder portion of the top panel for at least partially retaining the dispenser in a closed position after initial opening of the dispenser.

19. The carton of claim 1, wherein the at least one side end flap comprises a main portion, and the upper flap is foldably connected to the main portion along a lateral fold line.

20. The carton of claim 19, wherein the upper flap of the at least one side end flap extends in an oblique direction with respect to the top panel and the main portion of the at least one side end flap.

21. The carton of claim 19, wherein the at least two end flaps comprises at least one top end flap foldably connected to the top panel, and the at least one spacer panel is oblique with respect to the at least one top end flap and the main portion of the at least one side end flap.

22. In combination, a carton blank and a reinforcing insert for forming a carton for holding a plurality of containers, the carton blank comprising:

a plurality of panels comprising a top panel, a bottom panel, a first side panel, and a second side panel;

at least two end flaps respectively foldably attached to respective panels of the plurality of panels for overlapping to at least partially close an end of a carton formed from the carton blank, wherein the at least two end flaps comprises at least one side end flap foldably connected to at least the first side panel or the second side panel, the at least one side end flap comprising an upper flap;

the reinforcing insert comprising:

a central panel at least partially in face-to-face contact with the top panel;

at least one reinforcing end flap at least partially in face-to-face contact with at least one of the at least two end flaps;

at least one reinforcing side flap foldably connected to the central panel; and at least one spacer panel foldably connected to the central panel and the at least one reinforcing end flap, the at least one spacer panel for being positioned to extend in an oblique direction with respect to the top panel when the carton is formed from the carton blank and the insert blank, wherein the upper flap of the at least one side end flap is for at least partially engaging the at least one spacer panel when the carton is formed from the carton blank and the insert blank;

wherein dispenser features comprise at least a portion of the top panel and at least a portion of the central panel.

23. The combination of claim 22, wherein the at least one reinforcing side flap comprises a first reinforcing side flap and a second reinforcing side flap, wherein each of the first and second reinforcing side flaps is for being positioned to extend in an oblique direction with respect to the top panel, and at least a portion of each of the first and second reinforcing side flaps is adjacent the respective first and second side panels.

24. The combination of claim 22, wherein the at least one reinforcing end flap is for being positioned at least partially in face-to-face contact with an exterior surface of the at least one side end flap and the at least one spacer panel is for being positioned at least partially in face-to-face contact with the upper flap of the at least one side end flap.

25. The combination of claim 24, wherein the at least one side end flap comprises at least one lateral edge for being positioned adjacent the top panel, and the upper flap of the at least one side end flap is at least partially defined by a fold line that is spaced apart from the at least one lateral edge of the at least one side end flap.

26. The combination of claim 25, wherein the at least one side end flap comprises a first side end flap foldably connected to the first side panel and a second side end flap foldably connected to the second side panel, the upper flap of each of the first and second side end flaps is for being positioned at least partially in face-to-face contact with the at least one spacer panel, the at least one end flap further comprises a top end flap, and the reinforcing end flap is for being positioned at least partially in face-to-face contact with an interior surface of the top end flap.

27. The combination of claim 22, wherein the at least two end flaps comprise at least two first end flaps being for closing a first end of the carton formed from the carton blank, and the carton blank further comprises at least two second end flaps for overlapping to at least partially close a second end of the carton formed from the carton blank, the at least one reinforcing end flap comprises a first reinforcing end flap that is for being positioned at least partially in face-to-face contact with at least one of the at least two first end flaps and a second reinforcing end flap that is for being positioned at least partially in face-to-face contact with at least one of the at least two second end flaps.

28. The combination of claim 22, wherein the at least two end flaps and the at least one reinforcing end flap comprise handle features for forming a handle in a closed end of the carton formed from the carton blank and the reinforcing insert.

29. The combination of claim 28, wherein the at least two end flaps further comprises a top end flap, and the handle features comprise a handle cutout extending in the at least one side end flap, an inner handle flap foldably connected to the at least one reinforcing end flap along a first fold line, and an outer handle flap foldably connected to the top end flap along a second fold line, at least a portion of the inner handle flap is for being aligned with the handle cutout and the outer handle flap.

30. The combination of claim 29, wherein at least a portion of the upper flap is for being disposed between the handle cutout and the top panel when the carton is formed from the carton blank and the insert blank.

31. The combination of claim 22, wherein the dispenser features comprise at least one outer dispenser panel at least partially defined by an outer tear line extending in at least the top panel and at least one inner dispenser panel at least partially defined by an inner tear line extending in at least the central panel.

32. The combination of claim 31, wherein the dispenser features further comprise an outer finger panel extending in at least the top panel adjacent the at least one outer dispenser panel and an inner finger panel extending in at least the central panel adjacent the at least one inner dispenser panel, the inner finger panel being generally aligned with the outer finger panel.

33. The combination of claim 32, wherein the at least one outer dispenser panel comprises a first outer dispenser panel adjacent a second outer dispenser panel with the outer finger panel disposed therebetween, and the at least one inner dispenser panel comprises a first inner dispenser panel adjacent a second inner dispenser panel with the inner finger panel disposed therebetween.

34. The combination of claim 31, wherein the at least one outer dispenser panel is connected to at least one panel of the plurality of panels along a lateral fold line, and the outer tear line comprises a first outer oblique segment extending from a first end of the lateral fold line, a first outer longitudinal segment extending from the first outer oblique segment, a second outer oblique segment extending from a second end of the lateral fold line, and a second outer longitudinal segment extending from the second outer oblique segment.

35. The combination of claim 34, wherein the inner tear line comprises a first inner oblique segment extending in the at least one reinforcing side flap and the central panel, a first inner longitudinal segment extending from an end of the first inner oblique segment in the central panel, a second inner oblique segment extending in the at least one reinforcing side flap and the central panel, and a second inner longitudinal segment extending from an end of the second inner oblique segment in the central panel, at least a portion of each of the first and second inner longitudinal segments being generally aligned with the respective first and second outer longitudinal segments of the outer tear line.

36. The combination of claim 35, wherein each of the first and second inner longitudinal segments of the inner tear line is longer than the respective first and second outer longitudinal segments of the outer tear line so that at least a portion of the at least one inner dispenser panel is wider than an adjacent portion of the at least one outer dispenser panel at least partially defined between the first and second outer oblique segments of the outer tear line.

37. The combination of claim 31, wherein the top panel comprises at least one remainder portion disposed between the at least one outer dispenser panel and an edge of the top panel, at least a portion of the at least one inner dispenser panel being in face-to-face contact with the remainder portion of the top panel for at least partially retaining the dispenser in a closed position after initial opening of the dispenser features.

38. The combination of claim 22, wherein the at least one side end flap comprises a main portion, and the upper flap is foldably connected to the main portion along a lateral fold line.

39. The combination of claim 38, wherein the upper flap of the at least one side end flap extends in an oblique direction with respect to the top panel and the main portion of the at least one side end flap when the carton is formed from the insert blank and the carton blank.

40. The combination of claim 38, wherein the at least two end flaps comprises at least one top end flap foldably connected to the top panel, and the at least one spacer panel is oblique with respect to the at least one top end flap and the main portion of the at least one side end flap when the carton is formed from the insert blank and the carton blank.

41. A method of forming a carton comprising:

obtaining a carton blank comprising a plurality of panels comprising a top panel, a bottom panel, a first side panel, and a second side panel, at least two end flaps respectively foldably attached to respective panels of the plurality of panels, and dispenser features comprising at least a portion of the top panel, wherein the at least two end flaps comprises at least one side end flap foldably connected to at least the first side panel or the second side panel, the at least one side end flap comprising an upper flap;

obtaining a reinforcing insert comprising a central panel, at least one reinforcing end flap, at least one reinforcing side flap foldably connected to the central panel, and at least one spacer panel that is foldably connected to the central panel and the at least one reinforcing end flap, the dispenser features comprising at least a portion of the central panel;

positioning the reinforcing insert relative to the carton blank so that the central panel overlaps at least a portion of the top panel and the reinforcing end flap overlaps at least a portion of at least one flap of the at least two end flaps;

forming an interior of the carton at least partially defined by the plurality of panels, the forming the interior of the carton comprising forming an open-ended sleeve;

positioning the at least two end flaps and the at least one reinforcing end flap to at least partially close an end of the open-ended sleeve, the at least partially closing the end of the open-ended sleeve comprising positioning the at least one spacer panel to extend in an oblique direction with respect to the top panel and positioning the upper flap of the at least one side end flap to at least partially engage the at least one spacer panel.

42. The method of claim 41, wherein the forming the open-ended sleeve further comprises positioning the at least one reinforcing side flap to extend in an oblique direction with respect to the top panel with at least a portion of the at least one reinforcing side flap adjacent the first side panel or the second side panel.

43. The method of claim 41, wherein the at least partially closing the end of the open-ended sleeve further comprising positioning the at least one reinforcing end flap to be at least partially in face-to-face contact with an exterior surface of the at least one side end flap and positioning the at least one spacer panel to be at least partially in face-to-face contact with the upper flap of the at least one side end flap.

44. The method of claim 41, wherein the at least two end flaps further comprises a top end flap, the at least one side end flap comprising a handle cutout, wherein an inner handle flap is foldably connected to the at least one reinforcing end flap along a first fold line, and an outer handle flap is foldably connected to the top end flap along a second fold line.

45. The method of claim 44, wherein the at least partially closing the end of the open-ended sleeve comprises aligning at least a portion of the inner handle flap with the handle cutout and the outer handle flap.

46. The method of claim 41, wherein the dispenser features comprise at least one outer dispenser panel at least partially defined by an outer tear line extending in at least the top panel and at least one inner dispenser panel at least partially defined by an inner tear line extending in at least the central panel.

47. The method of claim 46, wherein the dispenser features further comprise an outer finger panel extending in at least the top panel adjacent the at least one outer dispenser panel and an inner finger panel extending in at least the central panel adjacent the at least one inner dispenser panel, the positioning the reinforcing insert relative to the carton blank comprises aligning the inner finger panel with the outer finger panel.

48. The method of claim 47, wherein the at least one outer dispenser panel comprises a first outer dispenser panel adjacent a second outer dispenser panel with the outer finger panel disposed therebetween, and the at least one inner dispenser panel comprises a first inner dispenser panel adjacent a second inner dispenser panel with the inner finger panel disposed therebetween.

49. The method of claim 46, wherein the top panel comprises at least one remainder portion disposed between the at least one outer dispenser panel and an edge of the top panel, at least a portion of the at least one inner dispenser panel being in face-to-face contact with the remainder portion of the top panel for at least partially retaining the dispenser in a closed position after initial opening of the dispenser features.

50. The method of claim 41, wherein the at least one side end flap comprises a main portion, and the upper flap is foldably connected to the main portion along a lateral fold line.

51. The method of claim 50, wherein the at least partially closing the end of the open-ended sleeve comprises positioning the upper flap of the at least one side end flap to extend in an oblique direction with respect to the top panel and the main portion of the at least one side end flap.

52. The method of claim 50, wherein the at least two end flaps comprises at least one top end flap foldably connected to the top panel, and the at least one spacer panel is oblique with respect to the at least one top end flap and the main portion of the at least one side end flap after the positioning the at least one spacer panel.

53. A carton for holding a plurality of containers, the carton comprising:

a plurality of panels that extends at least partially around an interior of the carton, the plurality of panels comprising a top panel, a bottom panel, a first side panel, and a second side panel;

at least two end flaps respectively foldably attached to respective panels of the plurality of panels, the at least two end flaps being overlapped with respect to one another to thereby at least partially form a closed end of the carton, the at least two end flaps comprising a top end flap and at least one side end flap, the at least one side end flap comprising an upper flap;

a reinforcing insert comprising a reinforcing end flap and a spacer panel foldably connected to the reinforcing end flap, the spacer panel extending in an oblique direction with respect to the top panel, the reinforcing end flap being at least partially in face-to-face contact with an exterior surface of the at least one side end flap and at least partially in face-to-face contact with an interior surface of the top end flap, wherein the upper flap of the at least one side end flap at least partially engages the spacer panel.

54. The carton of claim 53, wherein the at least one side end flap comprises a first side end flap foldably connected to the first side panel and a second side end flap foldably connected to the second side panel, the upper flap of each of the first and second side end flaps being at least partially in face-to-face contact with the spacer panel.

55. The carton of claim 53, wherein the at least one side end flap comprises a handle cutout, an inner handle flap is foldably connected to the reinforcing end flap along a first fold line, and an outer handle flap is foldably connected to the top end flap along a second fold line, at least a portion of the inner handle flap being aligned with the handle cutout and the outer handle flap.

56. The carton of claim 55, wherein the reinforcing end flap is a first reinforcing end flap connected to the spacer panel at a first fold line and the reinforcing insert further comprises a second reinforcing end flap connected to the spacer panel at a second fold line.

57. The carton of claim 56, wherein the second reinforcing end flap is at least partially in face-to-face contact with the top panel.

58. The carton of claim 53, wherein the at least one side end flap comprises a main portion, and the upper flap is foldably connected to the main portion along a lateral fold line.

59. The carton of claim 58, wherein the upper flap of the at least one side end flap extends in an oblique direction with respect to the top panel and the main portion of the at least one side end flap.

60. The carton of claim 58, wherein the at least one spacer panel is oblique with respect to the at least one top end flap and the main portion of the at least one side end flap.

* * * * *